US010401776B2

(12) United States Patent
Okubo et al.

(10) Patent No.: US 10,401,776 B2
(45) Date of Patent: Sep. 3, 2019

(54) IMAGE FORMING APPARATUS AND CONTROL METHOD

(71) Applicant: Konica Minolta, Inc., Chiyoda-ku, Tokyo (JP)

(72) Inventors: Takahiro Okubo, Kanagawa (JP); Yasuo Shiokawa, Tokyo (JP); Yoshiteru Kawakami, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/997,821

(22) Filed: Jun. 5, 2018

(65) Prior Publication Data

US 2018/0356762 A1 Dec. 13, 2018

(30) Foreign Application Priority Data

| | | |
|---|---|---|
| Jun. 9, 2017 | (JP) | 2017-114617 |
| Jun. 9, 2017 | (JP) | 2017-114621 |
| Jul. 20, 2017 | (JP) | 2017-140485 |
| May 17, 2018 | (JP) | 2018-095722 |

(51) Int. Cl.
*G03G 15/00* (2006.01)

(52) U.S. Cl.
CPC ..... *G03G 15/6561* (2013.01); *G03G 15/5054* (2013.01)

(58) Field of Classification Search
CPC ..... G03G 15/5054; G03G 15/6561; G03G 15/6564; G03G 15/6567
See application file for complete search history.

(56) References Cited

U.S. PATENT DOCUMENTS

2010/0189486 A1* 7/2010 Inoue ..... G03G 15/657 399/395

FOREIGN PATENT DOCUMENTS

| | | |
|---|---|---|
| JP | 2013-091563 A | 5/2013 |
| JP | 2014-133634 A | 7/2014 |

* cited by examiner

*Primary Examiner* — Hoang X Ngo
(74) *Attorney, Agent, or Firm* — Buchanan Ingersoll & Rooney PC

(57) ABSTRACT

An image forming apparatus that highly precisely suppresses misregistration of an image relative to a sheet due to sub-scanning skew and a control method are provided. The image forming apparatus includes: displacement rollers including at least a pair of rollers conveying a sheet that is being conveyed, toward a transfer section; a detection section that detects a position of a side end part of the sheet; and a hardware processor that performs processing for displacing the displacement rollers based on displacement control information and correcting the displacement control information for next and subsequent sheets based on a detection result of detection by the detection section after the displacement of the displacement rollers.

20 Claims, 18 Drawing Sheets

1121

| TIMING / PAPER TYPE | 1 | | | 2 | | | ··· | n | | |
|---|---|---|---|---|---|---|---|---|---|---|
| | CORRECTION VALUE FOR TARGET POSITION | DIRECTION | SPEED | CORRECTION VALUE FOR TARGET POSITION | DIRECTION | SPEED | ··· | CORRECTION VALUE FOR TARGET POSITION | DIRECTION | SPEED |
| PAPER TYPE A | 0.3 | + | $V_1$ | 0.4 | + | $V_1$ | ··· | – | – | – |
| PAPER TYPE B | 0.4 | + | $V_2$ | 0.5 | + | $V_2$ | ··· | 0.6 | + | $V_3$ |
| PAPER TYPE C | 0.5 | + | $V_1$ | 0.6 | + | $V_1$ | ··· | 0.7 | + | $V_2$ |
| ⋮ | ⋮ | ⋮ | ⋮ | ⋮ | ⋮ | ⋮ | ··· | ⋮ | ⋮ | ⋮ |

FIG. 4

IMAGE FORMING APPARATUS AND CONTROL METHOD

CROSS REFERENCE TO RELATED APPLICATIONS

The entire disclosures of Japanese Patent Application No. 2017-114621 filed on Jun. 9, 2017, No. 2017-114617 filed on Jun. 9, 2017, No. 2017-140485 filed on Jul. 20, 2017, and No. 2018-95722 filed on May 17, 2018 are incorporated herein by reference in their entirety.

BACKGROUND

Technological Field

The present invention relates to an image forming apparatus and a control method.

Description of Related Art

In recent years, multifunctional image forming apparatuses having a combination of functions such as a printer, a scanner, a copier and a facsimile have widely been used. In an image forming apparatus, at the time of formation of an image, a sheet is conveyed from a sheet feeding section or a reversing pathway to a transfer section, but the sheet may lean in a direction orthogonal to a conveyance direction (hereinafter may be referred to as "sheet width direction") because of, e.g., a mechanical factor in the apparatus. When printing processing is performed in a state in which leaning of a sheet occurs, the problem of deviation of a position of an image formed on the sheet from an original proper position occurs.

Therefore, in order to align an image and a sheet with each other with high precision in consideration of leaning of the sheet, registration displacement correction in which the sheet is sandwiched by registration rollers and displaced in the sheet width direction to correct the leaning of the sheet is performed. For example, Japanese Patent Application Laid-Open Nos. 2013-91563 and 2014-133634 each disclose an image forming apparatus in which registration rollers are disposed upstream of a position of formation of an image, a line sensor is disposed downstream of the registration rollers and upstream of a secondary transfer roller and a sheet is displaced in a sheet width direction based on an amount of leaning of the sheet, the amount being detected by the line sensor, to correct the leaning of the sheet.

However, in conventional techniques including Japanese Patent Application Laid-Open No. 2013-91563, registration rollers are displaced before a front end of a sheet reaches a secondary transfer roller, to adjust a position of a side end part of the sheet. However, with displacement before a sheet reaches a secondary transfer roller alone, a sub-scanning skew in which a sheet is skewed at a partway position in a conveyance direction (sub-scanning direction) thereof occurs due to misalignment of registration rollers, secondary transfer rollers and/or fixing rollers and a difference in diameter between the near side and the far side of each roller as the image forming apparatus is viewed from the front. Also, employment of skew correction in which a front end of a sheet is brought into abutment with registration rollers to correct a skew of the sheet enables correction of a skew of a front end of a sheet but the rear end side of the sheet is not corrected and thus distortion remains between the front end and the rear end, which may cause a sub-scanning skew (see FIG. 7). In particular, an elongated sheet is susceptible to the influence of such distortion, and thus prominently causes a sub-scanning skew. If printing is performed in a state in which a sub-scanning skew occurs, deviation of a position of formation of an image on a sheet occurs at a partway position.

Also, a method in which sub-scanning skew is suppressed by displacing registration rollers during conveyance of a sheet by a secondary transfer roller is conceivable. In this method, more specifically, control to consistently detect a side end part of a sheet via a line sensor after a start of displacement of registration rollers and when the side end part of the sheet reaches a target position, stop the displacement of the registration rollers is performed. However, even if registration displacement correction is performed during conveyance of a sheet by the secondary transfer roller, there is the problem of the sheet that is being conveyed being skewed again after the stoppage of the displacement of the registration rollers or registration rollers overrunning due to, e.g., variation in position or an inclination of a side end part of the sheet or looping or tensioning of the sheet between the respective rollers.

SUMMARY

An object of the present invention is to provide an image forming apparatus and a control method that enable high-precision suppression of misregistration of an image relative to a sheet due to sub-scanning skew.

To achieve the aforementioned object, an image forming apparatus according an aspect of the present invention is an image forming apparatus in which a sheet is conveyed to a position where an image is transferred by a transfer section to transfer the image onto the sheet, the apparatus comprising:

displacement rollers including at least a pair of rollers conveying an incoming sheet toward the transfer section;

a detection section that detects a position of a side end part of the sheet; and a hardware processor that performs processing for displacing the displacement rollers based on displacement control information and correcting the displacement control information for next and subsequent sheets based on a detection result of the detection by the detection section after the displacement of the displacement rollers.

To achieve the aforementioned object, a control method according to another aspect of the present invention is a displacement roller control method for an image forming apparatus including displacement rollers including at least a pair of rollers conveying a sheet that is being conveyed, toward a transfer section, and a detection section that detects a position of a side end part of the sheet, the method comprising:

displacing the displacement rollers based on displacement control information; and correcting the displacement control information for next and subsequent sheets based on a detection result of detection by the detection section after the displacement of the displacement rollers.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram illustrating example data stored in a displacement control table;

FIG. 6 is a flowchart illustrating processing in a case where a result of detection before power-off is applied after power-on;

FIG. 10A illustrates a state before movement of a registration roller pair and FIG. 10B illustrates a state after movement of the registration roller pair;

FIG. 15A illustrates an example of a case where a registration roller pair is moved to the left (L) side and FIG. 15B illustrates an example of a case where a registration roller pair is moved to the right (R) side;

FIG. 16A is a side view illustrating an example of a configuration in which a scraper is disposed on one registration roller of a registration roller pair to collect paper dust and FIG. 16B is a plan view of the same;

FIG. 17A is a side view illustrating propagation of vibration of a sheet to a transfer section and FIG. 17B is an enlarged side view illustrating transfer of an image onto an embossed sheet.

DETAILED DESCRIPTION OF EMBODIMENTS

Hereinafter, one or more embodiments of the present invention will be described with reference to the drawings. However, the scope of the invention is not limited to the disclosed embodiments.

[Configuration of Image Forming Apparatus 1000 According to Embodiment 1]

Figure 1:
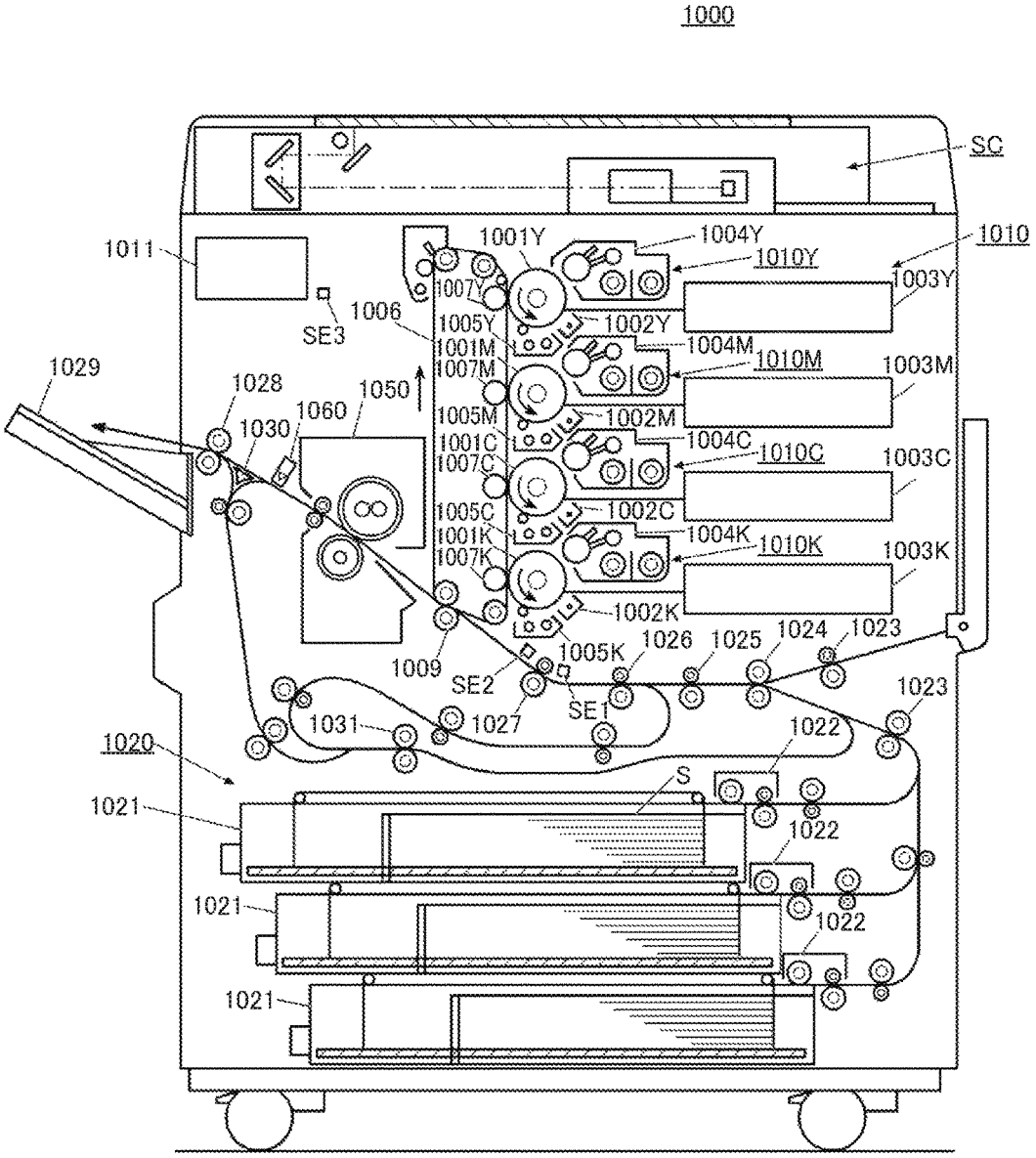
FIG. 1 is a configuration diagram schematically illustrating an image forming apparatus according to an embodiment of the present invention.

First, a configuration of image forming apparatus 1000 according to Embodiment 1 will be described. FIG. 1 is a configuration diagram schematically illustrating image forming apparatus 1000 according to the present embodiment. Image forming apparatus 1000 is an electrophotographic image forming apparatus, for example, a copier, and is what is called a tandem color image forming apparatus in which a plurality of photoconductors are vertically arranged so as to face a single intermediate transfer belt to form a full-color image.

Image forming apparatus 1000 includes original image reader SC, image forming section 1010, fixing device 1050, image reading section 1060 and control section 1011, which are housed inside a single casing.

Original image reader SC scans and exposes an original image via an optical system of a scanning/exposing device and reads reflected light from the original image via a line image sensor, thereby obtaining an image signal. This image signal is subjected to processing such as A/D conversion, shading correction, compression and then input to control section 1011 as image data. Here, the image input to control section 1011 as image data is not limited to one read via original image reader SC, and may be, for example, one received from a personal computer or another image forming apparatus connected to image forming apparatus 1000 via communication section 1013.

Image forming section 1010 includes, e.g., four image forming units 1010Y, 1010M, 1010C, 1010K, intermediate transfer belt 1006 and secondary transfer roller 1009. Image forming units 1010Y, 1010M, 1010C, 1010K are image forming unit 1010Y that forms a yellow (Y) image, image forming unit 1010M that forms a magenta (M) image, image forming unit 1010C that forms a cyan (C) image, and image forming unit 1010K that forms a black (K) image.

Image forming unit 1010Y is formed of photoconductor drum 1001Y, and charging section 1002Y, optical writing section 1003Y, developing device 1004Y and drum cleaner 1005Y disposed in the periphery thereof. Likewise, image forming units 1010M, 1010C, 1010K are formed of photoconductor drums 1001M, 1001C, 1001K, and charging sections 1002M, 1002C, 1002K, optical writing sections 1003M, 1003C, 1003K, developing devices 1004M, 1004C, 1004K and drum cleaners 1005M, 1005C, 1005K disposed in the respective peripheries thereof, respectively.

Respective surfaces of photoconductor drums 1001Y to 1001K are uniformly charged by respective charging sections 1002Y to 1002K, and on photoconductor drums 1001Y to 1001K, respective latent images are formed via scanning and exposure performed by optical writing sections 1003Y to 1003K. Furthermore, developing devices 1004Y to 1004K develop the respective latent images using toner and thereby visualize the latent images on respective photoconductor drums 1001Y to 1001K. Consequently, toner images of predetermined colors each corresponding to any of yellow, magenta, cyan and black are formed on respective photoconductor drums 1001Y to 1001K. The toner images formed on photoconductor drums 1001Y to 1001K are sequentially transferred to a predetermined position on rotating intermediate transfer belt 1006 by respective primary transfer rollers 1007Y, 1007M, 1007C, 1007K.

The toner image of the respective colors, which has been transferred onto intermediate transfer belt 1006, is transferred on sheet S conveyed at a predetermined timing by later-described sheet conveying section 1020, by secondary transfer roller 1009. Secondary transfer roller 1009 is a pressure contact member that is disposed so as to be in pressure contact with intermediate transfer belt 1006 and thereby forms a nip section (hereinafter referred to as "transfer nip section").

Sheet conveying section 1020 conveys sheets S along a conveyance pathway for sheets S. Sheets S are stored in each sheet feed tray 1021, and each sheet S stored in sheet feed tray 1021 is taken in by sheet feeding section 1022 and sent out to the conveyance pathway. Alternatively, sheets S are stored in a sheet feed tray included in a sheet feeding apparatus (not illustrated) connected to image forming apparatus 1000, and each sheet S retained by the sheet feeding apparatus is supplied from the sheet feeding apparatus to image forming apparatus 1000 and is thereby sent out to the conveyance pathway.

In the conveyance pathway, a plurality of conveyance units that convey sheet S is provided upstream of the transfer nip section. Each of the conveyance units is formed of a pair of rollers that are in pressure contact with each other, and conveys sheet S by at least one roller of the pair of rollers being driven and thus rotated through a drive mechanism mainly including an electric drive motor. Each pair of rollers forming a conveyance unit is configured in such a manner that the state of the rollers can be switched between a pressure contact state and a separated state.

In the present embodiment, from the upstream side to the downstream side of the conveyance pathway for sheets S, intermediate conveyance rollers 1023 to 1025, loop rollers 1026 and registration rollers 1027 are provided as conveyance units. Here, for the conveyance units, a wide variety of configurations each formed of a pair of rotary members such as a combination of belts and a combination of a belt and a roller other than a configuration formed of a pair of rollers, can be employed.

In such conveyance pathway as above, sheets S fed from sheet feed tray 1021 or the sheet feed tray of the sheet feeding apparatus are sequentially conveyed by the plurality of intermediate conveyance rollers 1023 to 1025 and loop roller 1026 provided from the upstream side to the downstream side and follows the conveyance pathway. When a front end of sheet S approaches registration rollers 1027, sheet S conveyed by intermediate conveyance rollers 1023 to 1025 and loop rollers 1026 are brought into abutment with registration rollers 1027 that are in a rotation-halted state, and then, loop rollers 1026 continue rotating for a predetermined period of time, and a loop is formed in sheet S. A skew of the front end of sheet S is corrected (skew correction).

Next, upon registration rollers 1027 starting rotating at a predetermined timing in synchronization with the toner image intermediate transfer belt 1006 bears, intermediate conveyance rollers 1023 to 1025 and loop rollers 1026 are switched from the pressure contact state to the separated state. In other words, after loop rollers 1026 transitions to the separated state, sheet S is conveyed by registration rollers 1027 alone. Registration rollers 1027 perform later-described displacement processing while conveying sheet S as displacement rollers, and convey sheet S to intermediate transfer belt 1006, which serves as an image bearing member, and the transfer nip section of secondary transfer roller 1009, which serves as a transfer section.

Figure 2:
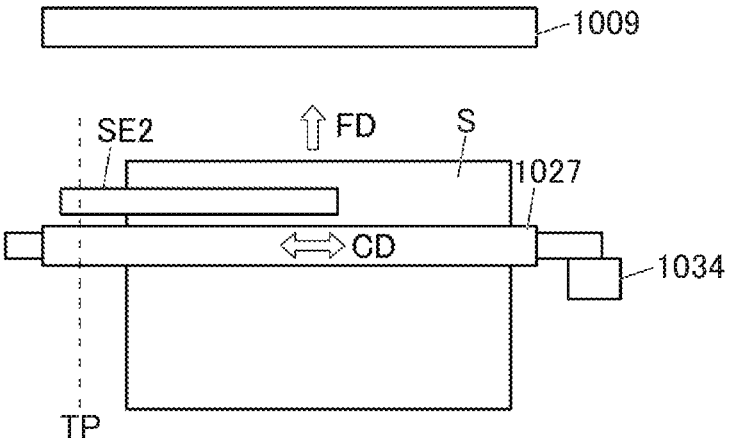
FIG. 2 is a diagram illustrating sheet displacement processing by registration rollers.

FIG. 2 is a diagram illustrating processing for displacement of sheet S by registration rollers 1027. Registration rollers 1027 are configured to be capable of being displaced in sheet width direction CD (direction orthogonal to sheet conveyance direction (sub-scanning direction) FD). Drive mechanism 1034 mainly including an electric motor is joined to registration rollers 1027, and can move in sheet width direction CD with a predetermined home position as a starting point, by being driven by drive mechanism 1034.

Registration rollers 1027 can move sheet S that is being conveyed, along sheet width direction CD, by moving in sheet width direction CD during a passage time period in which sheet S passes therethrough (displacement processing). Consequently, registration rollers 1027 adjust a position in sheet width direction CD of sheet S conveyed so as to align with a position of the toner image to be transferred. Here, a position which a side end part of sheet S should pass through in sheet width direction CD is referred to as "target position TP". Target position TP is a position expected to allow a positional relationship between sheet S and a toner image to be optimum in sheet width direction CD if a side end part of sheet S passes through that position (for example, a center in a width direction of sheet S and a center in a width direction of the toner image coincide with each other), registration rollers 1027 adjust the position in sheet width direction CD of sheet S conveyed so that the side end part of sheet S is in target position TP. A position that allows the positional relationship between sheet S and a toner image to be optimum is referred to as "optimum image position".

In the conveyance pathway, registration sensor SE1 and position detection sensor SE2 are provided, and based on results of detection by these sensors, operation of registration rollers 1027 is controlled by control section 1011.

Registration sensor SE1 is disposed between registration rollers 1027 and loop rollers 1026 in the conveyance pathway, and detects reaching of a front end of sheet S to a position of detection by the sensor (position a predetermined distance short of registration rollers 1027). A result of detection by the registration sensor SE1 is used for, e.g., detection of a timing for starting rotation of registration rollers 1027.

Position detection sensor SE2 is a detection section that detects a position in sheet width direction CD of a side end part of sheet S. For position detection sensor SE2, for example, a linear image sensor (for example, a CCD line sensor or the like) in which a plurality of light-receiving elements are arranged linearly along sheet width direction CD can be used. A result of detection by position detection sensor SE2 is used for determination of an amount of movement of registration rollers 1027 in displacement processing and/or grasping a timing of reaching of a front end of sheet S to the transfer nip section (that is, a timing of entry of a front end of sheet S onto secondary transfer roller 1009).

As illustrated in FIG. 1 again, fixing device 1050 is a device that subjects sheet S with a toner image transferred thereon, that is, sheet S sent out from the transfer nip section to fixing treatment, and is formed of, for example, a pair of fixing members (for example, a pair of rollers) and a heater that heats one or both of the fixing members. In a process of conveyance of sheet S, fixing device 1050 fixes a toner image to sheet S through an action of application of pressure by the pair of fixing members and heat the fixing members have.

Sheet S subjected to the fixing treatment by fixing device 1050 is read by image reading section (ICCU) 1060 and then is ejected onto sheet tray 1029 attached to an outer side surface of the casing, by sheet ejection rollers 1028. Also, if an image is formed also on a back surface of sheet S, sheet S with an image formed on a front surface thereof is read by image reading section 1060 and is then conveyed to reversing rollers 1031 provided on the lower side, by switching gate 1030. Reversing rollers 1031 sandwich a rear end of conveyed sheet S therebetween and then send sheet S backward to reverse sheet S, and send out sheet S to a sheet refeeding pathway. Sheet S sent out to the sheet refeeding pathway is conveyed by a plurality of sheet refeeding units, and sheet S is returned to the transfer nip section via registration rollers 1027. Here, sheet ejection rollers 1028, switching gate 1030, reversing rollers 1031 and the sheet refeeding units are included in sheet conveying section 1020 described above.

Image reading section 1060 includes, for example, a linear image sensor (for example, a CCD line sensor or the like), an optical system, a light source, etc., and reads sheet S with a toner image transferred thereon and outputs a read image obtained to control section 1011. Here, although in the present embodiment, image reading section 1060 is one that can measure colors of a toner image on sheet S, image reading section 1060 is not specifically limited as long as image reading section 1060 can recognize at least an area of sheet S and an area of a toner image. Also, although in the present embodiment, image reading section 1060 is disposed at a position downstream of fixing device 1050 and short of a position at which the conveyance pathway is switched by switching gate 1030, a disposed position of image reading section 1060 is not specifically limited as long as the disposed position is a position that is downstream of secondary transfer roller 1009 (transfer nip section) and allows reading of both surfaces (which may be each of the surfaces) of sheet S. It should be understood that image reading section 1060 may be disposed downstream of image forming apparatus 1000 as an optional device.

Figure 3:
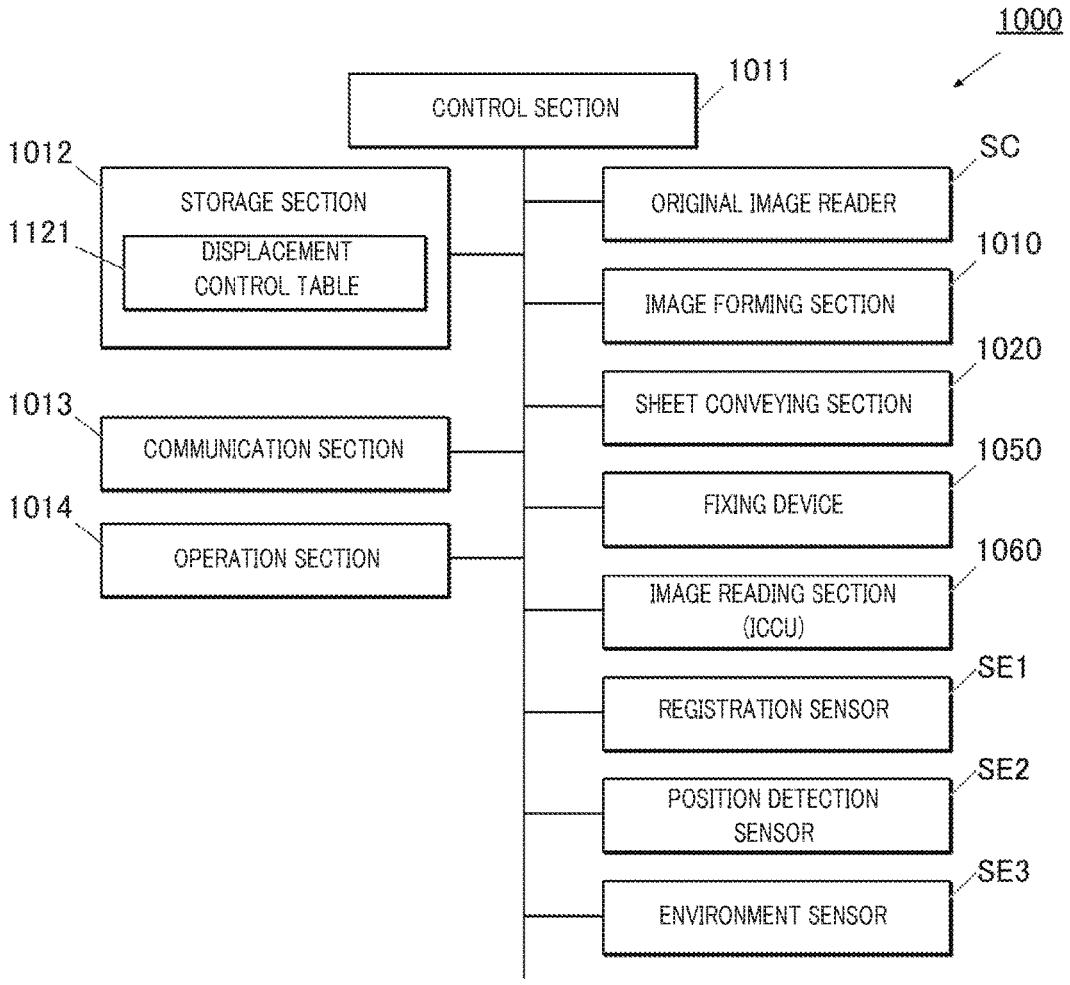
FIG. 3 is a block diagram schematically illustrating a configuration of a control system in the image forming apparatus in FIG. 1.

FIG. 3 is a block diagram schematically illustrating a configuration of a control system in image forming apparatus 1000 according to the present embodiment. As illustrated in FIG. 3, control section 1011 is connected to storage section 1012, communication section 1013, operation section 1014, original image reader SC, image forming section 1010, sheet conveying section 1020, fixing device 1050, image reading section 1060, registration sensor SE1, position detection sensor SE2 and environment sensor SE3. Control section 1011 is formed of, e.g., a CPU and a RAM. The CPU in control section 1011 reads a system program and various processing programs stored in storage section 1012 and develops such programs on the RAM and performs centralized control of operation of the respective sections of image forming apparatus 1000 according the developed programs.

Storage section 1012 is formed of, e.g., a non-volatile semiconductor memory or an HDD (hard disk drive), and stores, e.g., parameters and data necessary for the respective sections in addition to various programs to be executed by control section 1011. For example, in storage section 1012, displacement control table 1121 (see FIG. 4) is stored.

Communication section 1013 includes various interfaces such as an NIC (network interface card), a MODEM (modulator-demodulator), a USB (universal serial bus), and provides connection with external devices.

Operation section 1014 outputs various pieces of information set by a user to control section 1011. For operation section 1014, for example, a touch panel that enables an input operation to be performed according to information displayed on a display. Through operation section 1014, the user can set printing conditions, that is, types (including, for example, a basis weight, a size, a paper quality, etc.) of sheet S, a sheet feed tray to be used, a density of an image, a scale factor, double-sided printing or not, etc. Also, the user can input an instruction to execute a job or an instruction to perform operation in an adjustment mode, through operation section 1014. Also, control section 1011 can display various messages to the user via operation section 1014 by controlling operation section 1014.

Environment sensor SE3 includes, for example, a temperature sensor, a humidity sensor, etc., and detects a temperature and a humidity inside the casing of image forming apparatus 1000 and output results of the detection to control section 1011.

[Operation of Image Forming Apparatus 1000]

Next, an operation of image forming apparatus 1000 according to the present embodiment will be described. In the present embodiment, based on a detection result of detection by position detection sensor SE2 after displacement of registration roller 1027, control section 1011 in image forming apparatus 1000 performs processing for correcting displacement control information for next and subsequent sheets. In other words, control section 1011 functions as a correction section in the present invention. The present embodiment will be described taking a correction value for target position TP for sheet S, a displacement direction (+, −) and a displacement speed as examples of the displacement control information. Other examples of the displacement control information can include, e.g., a displacement distance and a displacement time length.

First, in image forming apparatus 1000, normal displacement processing in which registration rollers 1027 moves sheet S that is being conveyed, along sheet width direction CD, by moving along sheet width direction CD during a passage time period in which sheet S passes therethrough, based on a detection result of detection by position detection sensor SE2 and preset displacement control information.

Next, in the present embodiment, after displacement of registration rollers 1027 (after the normal displacement processing), processing for correcting the displacement control information for next and subsequent sheets is performed based on a detection result of detection at an arbitrary position in sheet conveyance direction (sub-scanning direction) FD by position detection sensor SE2 (position of a side end part of sheet S that is being conveyed (amount of deviation from target position TP)).

Here, in normal displacement processing, there are cases where displacement processing is performed at a plurality of positions (plurality of points) in sheet conveyance direction FD on one sheet S. As described above, where displacement processing is performed at each of a plurality of positions in sheet conveyance direction FD on one sheet S, displacement control information is set for each of the displacement positions. In this case, "detection result after displacement" includes respective detection results after respective displacement processing of one sheet S in addition to a detection result after all displacement processing of one sheet S. In other words, processing for correcting the displacement control information for next and subsequent sheets may be performed based on a detection result after all displacement processing of one sheet S or processing for correcting the displacement control information for next and subsequent sheets may be performed based on respective detection results after respective displacement processing of one sheet S.

Also, the "next sheet onward" includes sheet S subsequent to the next sheet and sheets S subsequent thereto. However, constantly performing processing for correcting the displacement control information for a "next sheet" is most favorable because correction can be made based on a latest detection result.

Here, an amount of displacement of registration rollers 1027 and an amount of movement of sheet S are not necessarily equal to each other. In other words, there are cases where even though registration rollers 1027 are displayed by 5 mm, sheet S is not moved by 5 mm (for example, is moved only by 4.8 mm). Therefore, in determining an amount of displacement of registration rollers 1027, an amount of deviation of a position of a side end part of sheet S from target position TP may be multiplied by a coefficient (displacement amount=sheet position deviation amount×coefficient $\alpha$). The coefficient may be set in advance or may be corrected according to the sheet position deviation amount.

Although in the present embodiment, where displacement processing is performed at each of a plurality of positions in sheet conveyance direction FD on one sheet S, the displacement control information is set for each displacement position, the displacement control information does not necessarily need to be constant for each of the plurality of positions. For example, an amount of displacement of registration rollers 1027 (correction value) may be different between a front end and a rear end of sheet S. More specifically, it is possible that the displacement amount is made small for a front end of sheet S so as to avoid large displacement and the displacement amount is made large for a rear end of sheet S so as to provide large displacement to achieve linear sheet conveyance. This is because as sheet S is longer, deviation on the rear end side becomes larger under the influence of alignment in the respective units for sheet conveyance.

Even if the displacement control information is set for each of displacement positions, it is not necessarily necessary to correct the displacement control information at all of displacement positions on next and subsequent sheets, and it is only necessary to correct the displacement control information at least at one position (for example, a rearmost end).

An example method for correcting displacement control information for next and subsequent sheets based on a detection result of detection by position detection sensor SE2 after displacement of registration rollers 1027 is a method in which an inclination of sheet S (sub-scanning skew) is calculated based on results of detection at a plurality of positions after displacement and displacement control information for next and subsequent sheets is corrected based on the calculated inclination of sheet S.

Here, the inclination of sheet S can be calculated by, where X1 and X2 are respective coordinates in sheet conveyance direction FD of two points at which a position of a side end part of a sheet has been detected, dividing a "difference in sheet width direction between X1 and X2" by a "conveyance distance between X1 and X2".

As described above, calculating an inclination of sheet S based on results of detection at a plurality of positions after displacement enables reduction in number of detections of a position of a side end part of the sheet and thus enables enhancement in processing speed.

In the above-described correction method, it is more preferable to calculate an inclination of sheet S based on detection results of detection by position detection sensor SE2 at a plurality of positions after displacement of registration rollers 1027 but before next displacement. This is because a position of a side end part of a sheet is not detected during displacement of registration rollers 1027 and an inclination of sheet S thus can be calculated more accurately.

Furthermore, another example method for correcting displacement control information for next and subsequent sheets based on a detection result of detection by position detection sensor SE2 after displacement of registration rollers 1027 is a method in which displacement control information for next and subsequent sheets is corrected based on detection results of detection of a plurality of sheets S by position detection sensor SE2. In other words, results of detection as detected by position detection sensor SE2 are not constantly applied to a next sheet but variations, and instead a tendency of sheet conveyance and displacement processing are grasped based on results of detection of a certain number of sheet S (for example, ten sheets) to correct displacement control information for next and subsequent sheets.

Examples of a method for calculating a correction value from results of detection of a plurality of sheets S include, e.g., simple averaging, weighted averaging and moving averaging.

For a specific feedback method in the above-described method, for example, a method in which a correction value is calculated for every ten sheets and the correction value is applied to next ten sheets may be employed. Also, for example, a method in which a correction value is calculated for last ten sheets and the correction value is applied to a next sheet may be employed. In other words, results of detection of first to tenth sheets may be applied to eleventh sheet S and results of detection of second to eleventh sheets may be applied to twelfth sheet S.

Here, variations in position of side end parts of sheets S differ depending on conditions relating to sheet conveyance (predetermined conditions that affect sheet conveyance). Therefore, it is necessary to change displacement control information (correction value for target position TP for sheet S, a displacement direction (+, −) and a displacement speed) for next and subsequent sheets according to the difference of variations in position of the side end part of sheet S, for each of the conditions relating to sheet conveyance. Examples of the conditions relating to sheet conveyance include, e.g., paper types (including a basis weight, a size, a paper quality, etc.) of sheet S, a coverage, an environment (for example, a temperature and a humidity), a sheet side on which an image is to be formed (front side (side 1)/back side (side 2)) and a sheet feed tray. For example, if sheet S is of a thin paper type, it is necessary to provide a larger correction value because sheet S easily bends in comparison to those of normal paper or heavy paper.

In the present embodiment, a stable that stores the displacement control information for each of the conditions relating to sheet conveyance is stored in storage section 1012. FIG. 4 illustrates an example of a table (displacement control table 1121) in which the displacement control information is stored for each paper type.

In the present embodiment, registration rollers 1027 are controlled so as to be displaced at a plurality of timings (referred to as "displacement timings") set in advance, and in displacement control table 1121, the displacement control information to be used at each of the displacement timings (timings 1 to n) are stored. Here, in order to write a toner image to an optimum image position in sheet S with good accuracy, it is preferable that in displacement control table 1121, the displacement control information to be used for each of the displacement timings (timings 1 to n) be stored for each of the paper types, each of coverages, each of environments, each of sheet sides on which an image is to be formed and each of sheet feed trays, or each of combinations thereof.

Storing displacement control table 1121 in storage section 1012 in such a manner as described above enables displacement control information to be properly determined according to the respective conditions.

Then, in the present embodiment, for each of conditions relating sheet conveyance, the displacement control information for a next sheet having a condition that is the same as the condition is corrected. For example, where sheets are fed from trays in the order of "tray 1, tray 1, tray 1, tray 5, tray 1 and tray 5 . . . " in, e.g., a mixed loading mode, a result of detection of sheet S fed from tray 1 is fed back to sheet S fed from tray 1 next, and a result of detection of sheet S fed from tray 5 is fed back to sheet S fed from tray 5 next.

Also, coverages of sheets S are classified into, for example, 0% to 40%, 41% to 60% and 61% to 100%, and the displacement control information for a next sheet having a same condition is corrected (for example, a result of detection of sheet S having a coverage of 0% to 40% may be fed back to next sheet S having a coverage of 0% to 40%). Also, a correction value may be multiplied by a value of a coverage as a coefficient.

Also, in the present embodiment, where an image is transferred to each of both sides of sheet S, the displacement control information for the back side of sheet S is corrected based on information on the front side (for example, a coverage (print information), etc.) of sheet S. In other words, in the present embodiment, "next sheet" is not limited to another sheet conveyed next, and a back side of sheet S may be "next sheet" by regarding a front side of sheet S as a last sheet.

Examples of the case where displacement control information for a back side of sheet S is corrected based on information on a front side thereof include, e.g., correcting displacement control information for a back side of sheet S based on a coverage of a front side of sheet S in consideration of, e.g., a slip ratio varying depending on the coverage of sheet S. In other cases, for example, where a result of detection of a front side of sheet S (amount of deviation from target position TP) by position detection sensor SE2 indicates an abnormal value, displacement control information for a back side thereof may be corrected using data of the abnormal value.

Also, in the present embodiment, displacement control information corrected based on a detection result of detection by position detection sensor SE2 after displacement of registration rollers 1027 is stored in storage section 1012. Consequently, a correction value can be used for a next job and after power-off.

Figure 5:
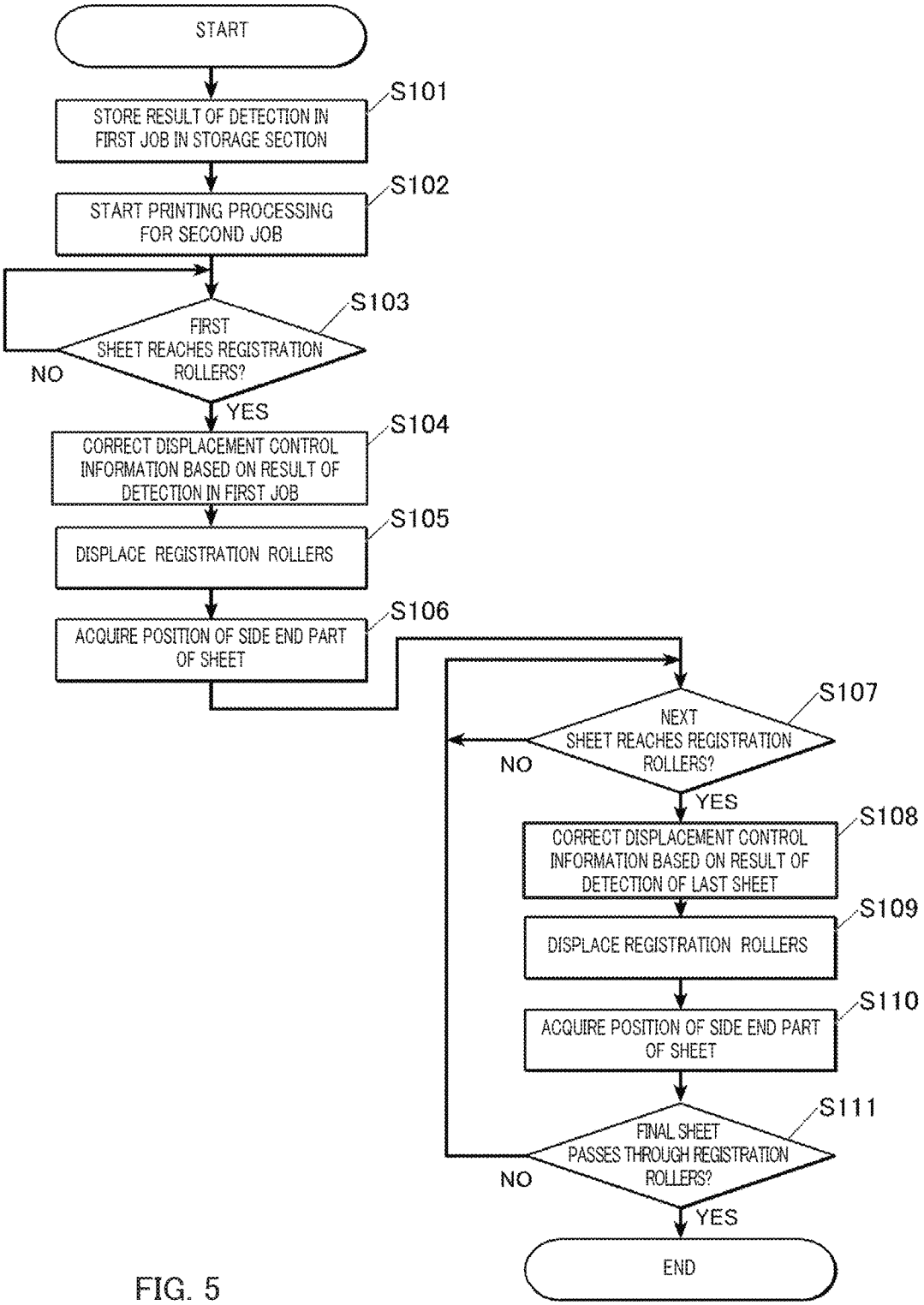
FIG. 5 is a flowchart illustrating processing in a case where a result of detection of a last job (first job) is applied to a next job (second job)

Processing in a case where a result of detection in a last job (first job) is applied to a next job (second job) will be described with reference to FIG. 5. This processing is started with an end of printing processing of the first job as a trigger.

First, control section 1011 in image forming apparatus 1000 stores a result of detection in the first job, in storage section 1012 (step S101). A result of detection in the first job is a result of detection of a final sheet in the first job (position of a side end part of a final sheet (amount of deviation from target position TP)).

Next, control section 1011 starts printing processing for the second job (step S102). Next, control section 1011 determines whether or not a first sheet reaches registration rollers 1027 based on a result of detection by registration sensor SE1 (step S103), and if it is determined that the first sheet reaches registration rollers 1027 (step S103: YES), displacement control information is corrected (fed back) based on the result of detection in the first job, the result being stored in storage section 1012 in step S101 (step S104).

Next, control section 1011 displaces registration rollers 1027 (step S105) and acquires a position of a side end part of sheet S, the position being detected by position detection sensor SE2 (step S106).

Next, control section 1011 determines whether or not a next sheet reaches registration rollers 1027, based on a result of detection by registration sensor SE1 (step S107), and if it is determined the next sheet reaches registration rollers 1027 (step S107: YES), the displacement control information is corrected based on the result of detection of the last sheet, the result being acquired in step S106 (step S108).

Next, control section 1011 displaces registration rollers 1027 (step S109), and acquires a position of a side end part of sheet S, the position being acquired by position detection sensor SE2 (step S110).

Next, control section 1011 determines whether or not a final sheet passes through registration rollers 1027, based on job information on the second job and a result of detection by registration sensor SE1 (step S111). More specifically, whether or not a final sheet passes through registration rollers 1027 is determined based on, e.g., the number of sheets and the size of the sheets in the second job and a length of time passed after a rear end of the final sheet passed by registration sensor SE1.

If it is determined that a final sheet passes through registration rollers 1027 (step S111: YES), the processing ends, and if it is determined that a final sheet does not pass through registration rollers 1027 (step S111: NO), the processing proceeds to step S107, and the processing in step S107 onward is repeated.

The above processing enables a result of detection in a last job (first job) to be applied to a next job (second job), and thus, misregistration of an image relative to sheet S can be suppressed in a first sheet onwards in a next job.

Figure 6:
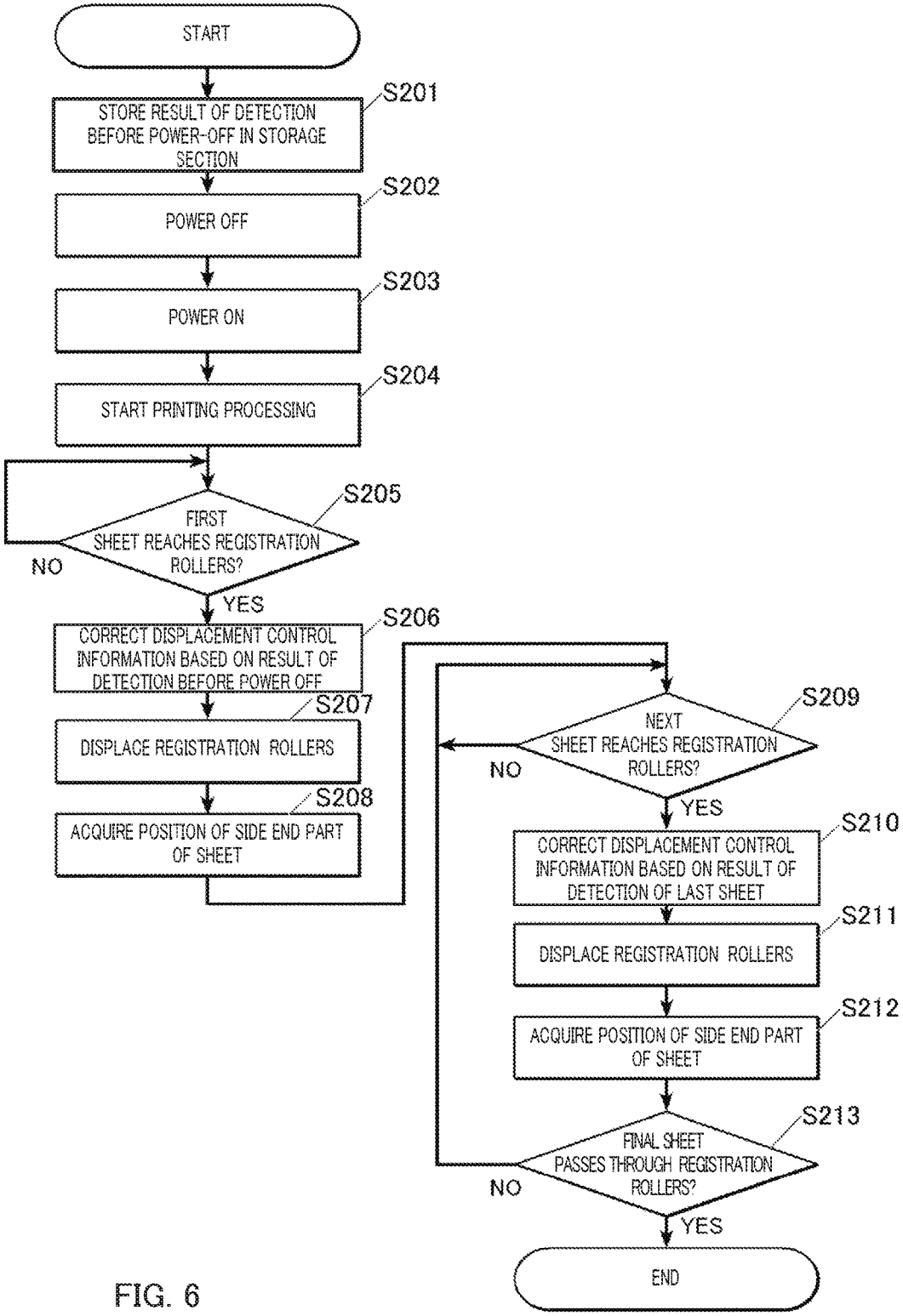
Figure 7:
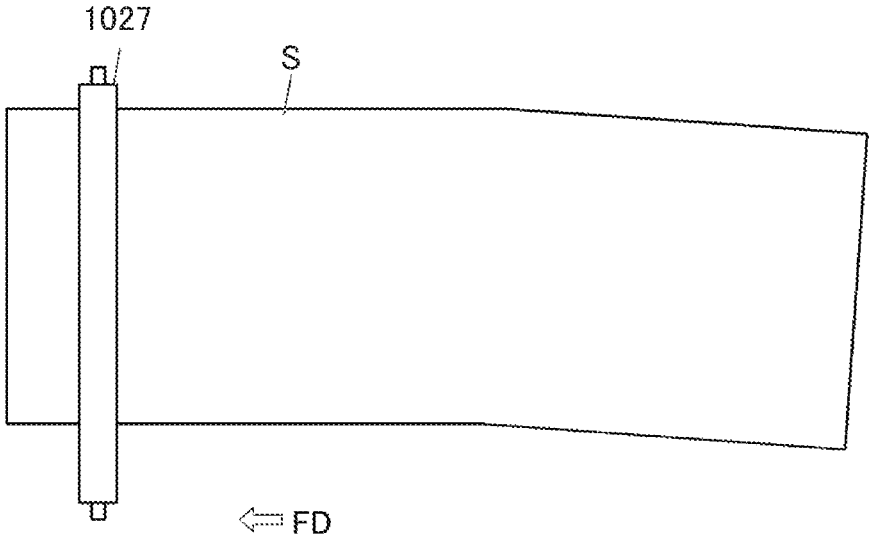
FIG. 7 is a diagram illustrating an example of a sub-scanning skew.

Next, processing in a case where a result of detection before power-off is applied after power-on will be described with reference to FIG. 6. This processing is started with an end of printing processing before power-off as a trigger.

First, control section 1011 in image forming apparatus 1000 stores a result of detection before power-off in storage section 1012 (step S201). The result of detection before power-off is a result of detection of a final sheet before power-off (position of a side end part of the final sheet (amount of deviation from target position TP)).

Next, control section 1011 powers off image forming apparatus 1000 based on an operation by a user (for example, depression of a power button) (step S202).

Next, control section 1011 powers on image forming apparatus 1000 based on an operation by a user (for example, depression of the power button) (step S203).

Next, control section 1011 starts printing processing for the second job (step S204).

Next, control section 1011 determines whether or not a first sheet reaches registration rollers 1027, based on a result of detection by registration sensor SE1 (step S205), and if it is determined that a first sheet reaches registration rollers 1027 (step S205: YES), displacement control information is corrected (fed back) based on the result of detection before power-off, the result being stored in storage section 1012 in step S201 (step S206).

Next, control section 1011 displaces registration rollers 1027 (step S207), and acquires a position of a side end part of sheet S, the position being detected by position detection sensor SE2 (step S208).

Next, control section 1011 determines whether or not a next sheet reaches registration rollers 1027 based on a result of detection by registration sensor SE1 (step S209), and if it is determined that the next sheet reaches registration rollers 1027 (step S209: YES), displacement control information is corrected based on the result of detection of the last sheet, the result being acquired in step S208 (step S210).

Next, control section 1011 displaces registration rollers 1027 (step S211), and acquires a position of a side end part of sheet S, the position being detected by position detection sensor SE2 (step S212).

Next, control section 1011 determines whether or not a final sheet passes through registration rollers 1027, based on job information and a result of detection by registration sensor SE1 (step S213). More specifically, whether or not a final sheet passes through registration rollers 1027 is determined based on, e.g., the number of sheets and the size of the sheets in the job and a length of time passed after a rear end of the final sheet passed by registration sensor SE1.

If it is determined that a final sheet passes through registration rollers 1027 (step S213: YES), the processing ends, and if it is determined that a final sheet does not pass through registration rollers 1027 (step S213: NO), the processing proceeds to step S209, and the processing in step S209 onward is repeated.

The above processing enables a result of detection before power-off to be applied after power-on, and thus, misregistration of an image relative to sheet S can be suppressed in a first sheet onwards after power-on.

Also, although in the present embodiment, processing for correcting displacement control information to be used to control displacement for next and subsequent sheets, based on a result of detection by position detection sensor SE2 after displacement of registration rollers 1027 during execution of a job is performed, image forming apparatus 1000 has the adjustment mode, and in the adjustment mode, a correction value can be set in displacement control table 1121 or corrected in advance before execution of a job. For example, upon provision of an instruction to perform operation in the adjustment mode by operation section 1014, control section 1011 causes a predetermined number of sheets S to be fed from sheet feed tray 1021 or a sheet feed tray in the sheet feeding apparatus, and images are formed by image forming units 1010Y to 1010K based on image data stored in storage section 1012 in advance and a toner image is transferred onto sheet S by secondary transfer roller 1009. Also, control section 1011 causes position detection sensor SE2 to detect a position of a side end part of sheet S with the toner image transferred thereon after displacement of registration rollers 1027, and calculates a correction value for displacement control information based on a result of the detection and sets the calculated correction value in displacement control table 1121 or corrects a relevant correction value based on the calculated correction value.

As described above, image forming apparatus 1000 has the adjustment mode, and thus, a correction value can be set in displacement control table 1121 or corrected in advance before execution of a job, enabling suppression of misregistration of an image relative to sheet S in a first sheet onward and thus enabling provision of well-finished print. The setting or correction of displacement control information is not limited to setting or correction of displacement control information in displacement control table 1121 and may be, for example, setting or correction of displacement control information as they are, without arranging such displacement control information in a table format.

[Timing for Displacement Processing]

Displacement processing and detection by position detection sensor SE2 in the present embodiment are performed, for example, at respective timings after a front end of sheet S reaching secondary transfer roller 1009 (that is, during conveyance of sheet S by secondary transfer roller 1009). This is because during conveyance of sheet S by secondary transfer roller 1009 or fixing device 1050, sheet S is directly affected by, e.g., alignment in secondary transfer roller 1009 or fixing device 1050, respectively, and thus, sub-scanning skew and/or variations of sheet S become larger. Performing the displacement processing and the detection at respective timings after a front end of sheet S entering secondary transfer roller 1009 as in the present embodiment enable effective suppression of sub-scanning skew and/or variations of sheet S.

Also, the displacement processing and the detection may be performed at respective timings before the front end of sheet S enters secondary transfer roller 1009.

[Specific Example of Displacement Processing]

As described above, displacement processing according to the present embodiment is a displacement operation of registration rollers 1027 in which registration rollers 1027 move along sheet width direction CD during a passage time period in which sheet S passes therethrough, based on a detection result of detection by position detection sensor SE2 and displacement control information set in advance, to move sheet S that is being conveyed along sheet width direction CD.

An example of the displacement processing according to the present embodiment is processing in which a position of a side end part of sheet S is detected by position detection sensor SE2, a distance to target position TP (corrected target position TP if corrected) (amount of displacement of registration rollers 1027) is determined from the position of the side end part of sheet S based on a result of the detection and registration rollers 1027 are displaced based on the determined displacement amount (first displacement processing).

Another example of the displacement processing according to the present embodiment is processing in which after registration rollers 1027 starting displacement in sheet width direction CD, whether or not a position of a side end part of sheet S reaches target position TP (corrected target position TP if corrected) is detected by position detection sensor SE2 and if it is detected that the position of the side end part of sheet S reaches target position TP, the displacement of registration rollers 1027 is stopped (second displacement processing).

In the present embodiment, either of the displacement processing may be performed. Also, for example, it is possible that before a front end of a sheet enters secondary transfer roller 1009, the first displacement processing is performed and after the front end of the sheet enters secondary transfer roller 1009, the second displacement processing is performed.

As described above, image forming apparatus 1000 according to the present embodiment includes: registration rollers 1027 (displacement rollers) including at least a pair of rollers conveying an incoming sheet toward secondary transfer roller 1009 (transfer section); position detection sensor SE2 (detection section) that detects a position of a side end part of the sheet; control section 1011 that displaces registration rollers 1027 based on displacement control information; and a correction section (control section 1011)

that corrects displacement control information for next and subsequent sheets based on a detection result of the detection by position detection sensor SE2 after the displacement of registration rollers 1027. In particular, control section 1011 displaces registration rollers 1027 based on the detection result of the detection by position detection sensor SE2 and the displacement control information.

Therefore, image forming apparatus 1000 according to the present embodiment enables high-precision suppression of misregistration of an image relative to a sheet due to sub-scanning skew because deviation of a position of a side end part of a sheet after displacement of registration rollers 1027 can be fed back to displacement control information for next and subsequent sheets.

Also, in image forming apparatus 1000 according to the present embodiment, control section 1011 displaces registration rollers 1027 at a plurality of positions in sheet conveyance direction FD for one sheet. Also, control section 1011 corrects displacement control information at at least one of a plurality of positions in next and subsequent sheets based on detection results of respective detections by position detection sensor SE2 after displacement of registration rollers 1027 at a plurality of positions. Also, displacement control information is not necessarily constant for each of the plurality of positions.

Therefore, image forming apparatus 1000 according to the present embodiment enables setting of a proper displacement amount for each position in sheet conveyance direction FD in consideration of an influence of alignment for sheet conveyance in each unit and thus enables high-precision suppression of misregistration of an image relative to a sheet due to sub-scanning skew.

Also, in image forming apparatus 1000 according to the present embodiment, control section 1011 calculates an inclination of a sheet based on detection results of detection by position detection sensor SE2 at plurality of positions in sheet conveyance direction FD after displacement of registration rollers 1027 and corrects displacement control information for next and subsequent sheets based on the calculated inclination of the sheet.

Therefore, image forming apparatus 1000 according to the present embodiment enables reduction in number of detections of a position of a side end part of a sheet and thus enables enhancement in processing speed.

Also, in image forming apparatus 1000 according to the present embodiment, control section 1011 calculates an inclination of a sheet based on detection results of detection by position detection sensor SE2 at a plurality of positions after displacement of registration rollers 1027 but before next displacement, and corrects displacement control information for next and subsequent sheets based on the calculated inclination of the sheet.

Therefore, image forming apparatus 1000 according to the present embodiment can prevent a position of a side end part of a sheet from being detected during displacement of registration rollers 1027, enabling more accurate calculation of an inclination of sheet S and thus enabling high-precision suppression of misregistration of an image relative to a sheet due to sub-scanning skew.

Also, in image forming apparatus 1000 according to the present embodiment, control section 1011 corrects displacement control information for next and subsequent sheets based on detection results of detection of a plurality of sheets by position detection sensor SE2.

Therefore, image forming apparatus 1000 according to the present embodiment enables grasping variations and tendencies of sheet conveyance and displacement processing and feeding the variations and the tendencies back to displacement control information for next and subsequent sheets and thus enables high-precision suppression of misregistration an image relative to a sheet due to sub-scanning skew.

Also, in image forming apparatus 1000 according to the present embodiment, for each of conditions relating to sheet conveyance, control section 1011 corrects displacement control information for a next sheet having a condition that is the same as the condition.

Therefore, image forming apparatus 1000 according to the present embodiment enables displacement control information to be corrected in consideration of a degree of sub-scanning skew varying depending on each condition relating to sheet conveyance and thus enables high-precision suppression of misregistration of an image relative to a sheet due to sub-scanning skew.

Also, in image forming apparatus 1000 according to the present embodiment, where an image is transferred to each of both sides of a sheet, control section 1011 corrects displacement control information for a back side of the sheet based on information on a front side of the sheet.

Therefore, image forming apparatus 1000 according to the present embodiment enables displacement control information for a back side of sheet S to be corrected in consideration of a degree of sub-scanning skew varying depending on information on the front side of sheet S and thus enables high-precision suppression of misregistration of an image relative to a sheet due to sub-scanning skew.

Also, in image forming apparatus 1000 according to the present embodiment, control section 1011 stores displacement control information corrected based on a detection result of detection by position detection sensor SE2 after displacement of registration rollers 1027, in storage section 1012.

Therefore, image forming apparatus 1000 according to the present embodiment enables use of a correction value for a next job or after power-off and thus enables suppression of misregistration of an image relative to sheet S in a first sheet onwards.

Also, image forming apparatus 1000 according to the present embodiment has the adjustment mode in which a sheet is fed and subjected to detection of a position of a side end part of the sheet by position detection sensor SE2 and displacement control information is set or corrected based on a result of the detection.

Therefore, in image forming apparatus 1000 according to the present embodiment, a correction value can be set or corrected in advance before execution of a job, enabling suppression of misregistration of an image relative to sheet S in a first sheet onward and thus enabling provision of well-finished print.

Also, in image forming apparatus 1000 according to the present embodiment, control section 1011 displaces registration rollers 1027 after a sheet entering secondary transfer roller 1009, and corrects displacement control information for next and subsequent sheets based on a detection result of detection by position detection sensor SE2 after the displacement of registration rollers 1027.

Therefore, image forming apparatus 1000 according to the present embodiment enables more effective suppression of sub-scanning skew and/or variations of sheets S and thus enables high-precision suppression of misregistration of an image relative to a sheet due to sub-scanning skew.

Also, in image forming apparatus 1000 according to the present embodiment, control section 1011 displaces registration rollers 1027 in a direction orthogonal to sheet conveyance direction FD of a sheet.

Therefore, image forming apparatus 1000 according to the present embodiment enables a sheet to be moved in sheet width direction CD efficiently with good precision and thus enables high-precision suppression of misregistration of an image relative to a sheet due to sub-scanning skew.

Although Embodiment 1 of the present invention has specifically been described above, the present invention is not limited to the above embodiment and various changes are possible.

For example, in the above embodiment, at a timing of a next sheet reaching registration rollers 1027, displacement control information is corrected based on a result of detection of a last sheet (see, for example, steps S104 and S108 in FIG. 5, and steps S206 and S210 in FIG. 6), but the present invention is not limited to this example. In other words, displacement control information may be corrected at any timing as long as such timing is a timing after obtainment of a result of detection of a last sheet but before displacement of registration rollers 1027.

Also, although the above embodiment has been described taking a configuration in which when control section 1011 displaces registration rollers 1027, control section 1011 displaces registration rollers 1027 in sheet width direction CD as an example, the present invention is not limited to this configuration. In other words, a configuration in which control section 1011 moves registration rollers 1027 in a direction other than sheet width direction CD (for example, a direction shifted by 5° from sheet width direction CD) may be employed as long as such configuration enables moving sheet S that is being conveyed, along sheet width direction CD.

Also, although the above embodiment has been described taking a configuration in which registration rollers 1027 are displaced based on displacement control information as an example, the present invention is not limited to this configuration. For example, instead of the above configuration, a configuration may be employed in which two pairs of rollers are provided as a rotary section capable of rotating incoming sheet S such that respective rotation speeds of the two roller pairs are made different from each other to rotate sheet S and move sheet S along sheet width direction CD. In this case, control section 1011 rotates a sheet via the two roller pairs based on rotation control information instead of displacement control information, and detects rotation control information for next and subsequent sheets based on a detection result of detection by position detection sensor SE2 after the rotation of the sheet by the two roller pairs.

Also, although the above description discloses an example in which a non-volatile memory, a hard disk or the like is used as a computer-readable medium for a program according to the present invention, the present invention is not limited to this example. As another example of the computer-readable medium, a portable recording medium such as a CD-ROM can be employed. Also, as a medium that provides data of a program according to the present invention via a communication channel, a carrier wave is employed.

Embodiment 2

Figure 8:
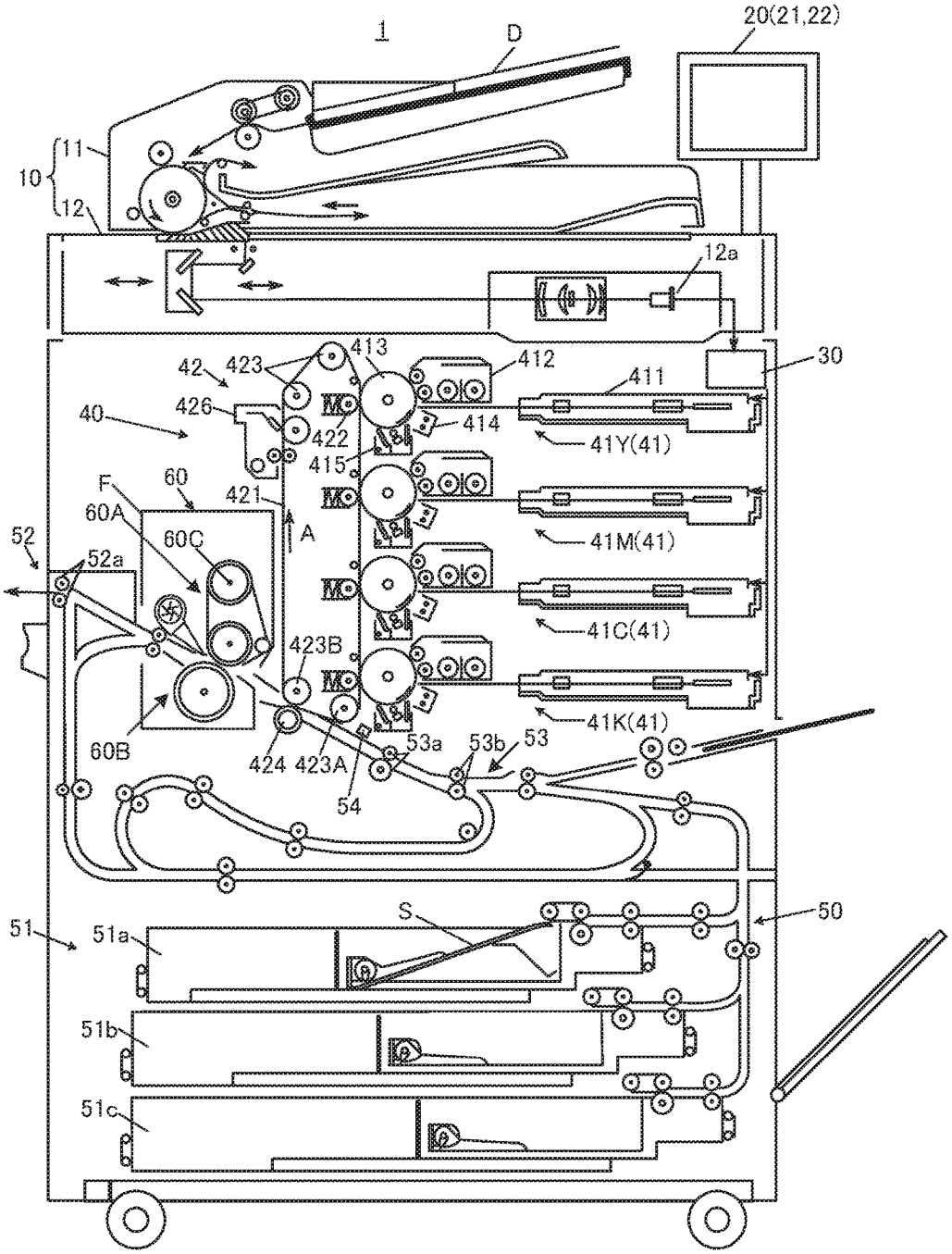
FIG. 8 is a diagram schematically illustrating an overall configuration of an image forming apparatus according to Embodiment 2.
Figure 9:
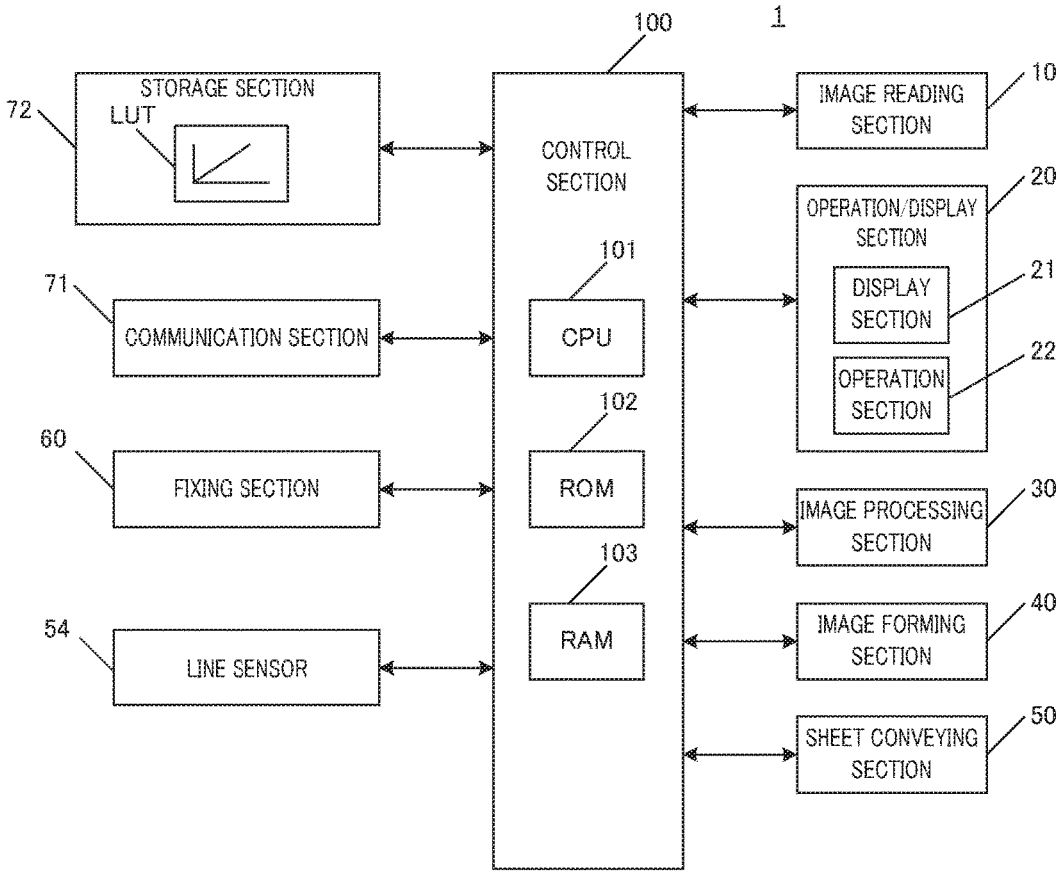
FIG. 9 is a block diagram illustrating a major part of a control system in the image forming apparatus in FIG. 8.

Next, an image forming apparatus according to Embodiment 2 will be described. FIG. 8 is a diagram schematically illustrating an overall configuration of image forming apparatus 1 according to Embodiment 2. FIG. 9 is a major part of a control system in image forming apparatus 1 according to the present embodiment.

Image forming apparatus 1 according to the present embodiment uses an elongated sheet or a non-elongated sheet as sheet S and forms an image on sheet S.

In the present embodiment, an elongated sheet refers to a flat sheet having a length in a conveyance direction that is longer than those of generally-used sheets such as A4-size or A3-size sheets. Hereafter, when "sheet" is simply referred to, the sheet may be an elongated sheet or a non-elongated sheet.

Image forming apparatus 1 is an intermediate transfer-type color image forming apparatus using an electrophotographic process technique. In other words, image forming apparatus 1 forms a toner image by performing primary transfer of toner images of respective colors, Y (yellow), M (magenta), C (cyan) and K (black), formed on respective photoconductor drums 413 onto intermediate transfer belt 421 to superimpose the four-color toner images on one another on intermediate transfer belt 421 and then performing secondary transfer of the four-color toner images onto a sheet.

Also, image forming apparatus 1 employs a tandem method in which photoconductor drums 413 for the four colors, that is, YMCK, are serially arranged in a direction in which intermediate transfer belt 421 moves and respective color toner images are sequentially transferred to intermediate transfer belt 421 in one step.

As illustrated in FIG. 9, image forming apparatus 1 includes, e.g., image reading section 10, operation/display section 20, image processing section 30, image forming section 40, sheet conveying section 50, fixing section 60 and control section 100.

Control section 100 includes, e.g., CPU (central processing unit) 101, ROM (read-only memory) 102 and RAM (random access memory) 103. CPU 101 reads a program according to the content of processing from ROM 102 and develops the program on RAM 103 and performs centralized control of operation of each block of image forming apparatus 1 in cooperation with the developed program. At this time, various data stored in storage section 72 are referred to. Storage section 72 is formed of, for example, a non-volatile semiconductor memory (what is called "flash memory") or a hard disk drive.

Control section 100 transmits/receives various data to/from an external apparatus (for example, a personal computer) connected via a communication network such as a LAN (local area network) or a WAN (wide area network), via communication section 71. Control section 100, for example, receives image data transmitted from the external apparatus and forms a toner image on a sheet based on the image data (input image data).

Communication section 71 is formed of, for example, a communication control card such as a LAN card.

Image reading section 10 includes, e.g., automatic document feeding device 11 called an ADF (auto document feeder) and original image scanning device 12 (scanner).

Automatic document feeding device 11 conveys document D placed on a document tray via a conveyance mechanism to feed document D to original image scanning device 12. Automatic document feeding device 11 can continuously read images of multiple documents D (which may be respective images on opposite sides of document D) placed on the document tray at once.

Original image scanning device 12 optically scans a document conveyed onto a contact glass plate from automatic document feeding device 11 or a document placed on the contact glass plate, forms an image of reflected light from the document on a light-receiving surface of CCD (charge-coupled device) sensor 12*a* and thereby reads the image of the document. Image reading section 10 generates input image data based on a result of the reading by original image scanning device 12. The input image data is subjected to predetermined image processing in image processing section 30.

Operation/display section 20 is formed of, for example, a touch panel-equipped liquid-crystal display (LCD: liquid-crystal display), and functions as display section 21 and operation section 22. Display section 21 displays, e.g., various operation screens, a status of an image and a status of operation of each function, according to display control signals input from control section 100. Operation section 22 includes various operation keys such as numeric keys and a start key, and receives various operation inputs by a user and outputs the resulting operation signals to control section 100.

Image processing section 30 includes, e.g., a circuit that performs digital image processing on input image data according to initial settings or user settings. For example, image processing section 30 performs tone correction based on tone correction data (tone correction table LUT) in storage section 72 under the control of control section 100. Also, image processing section 30 subjects input image data to, e.g., various correction processing such as color correction and/or shading correction and/or compression processing in addition to tone correction. Image forming section 40 is controlled based on the image data subjected to such processing.

Image forming section 40 includes, e.g., image forming units 41Y, 41M, 41C, 41K for forming images of color toners of a Y component, an M component, a C component and a K component based on input image data, and intermediate transfer unit 42.

Image forming units 41Y, 41M, 41C, 41K for the Y component, the M component, the C component and the K component have configurations that similar to one another. For ease of illustration and description, common components are provided with a same reference numeral, and where such common components are distinguished from one another, Y, M, C or K is provided to the reference numeral. In FIG. 8, reference numerals are provided only to the components of image forming unit 41Y for the Y component, and reference numerals for the components of other image forming units 41M, 41C, 41K are omitted.

Each image forming unit 41 includes, e.g., exposing device 411, developing device 412, photoconductor drum 413, charging device 414 and drum cleaning device 415.

Photoconductor drum 413 is, for example, a negatively-charged organic photoconductor (OPC) formed by sequentially stacking an undercoat layer (UCL), a charge generation layer (CGL) and a charge transport layer (CTL) on a peripheral surface of an aluminum conductive cylindrical body (aluminum element tube). The charge generation layer is formed of an organic semiconductor obtained by dispersing a charge generation material (for example, a phthalocyanine pigment) in a resin binder (for example, polycarbonate), and generates a pair of positive charge and negative charge upon exposure by exposing device 411. The charge transport layer is formed of a resin binder (for example, a polycarbonate resin) with a hole transport material (electron-donating nitrogen-containing compound) dispersed therein, and transports positive charge generated in the charge generation layer to a surface of the charge transport layer.

Control section 100 controls drive current to be supplied to a drive motor (illustration thereof omitted) that rotates photoconductor drum 413 to rotate photoconductor drum 413 at a constant circumferential velocity (linear velocity).

Charging device 414 uniformly negatively charges a photoconductive surface of photoconductor drum 413. Exposing device 411 is formed of, for example, a semiconductor laser, and applies laser light corresponding to an image of the relevant color component to photoconductor drum 413. Consequently, an electrostatic latent image of the relevant color component is formed on the surface of photoconductor drum 413 by means of a difference in potential between a part subjected to the laser light application and a part surrounding that part.

Developing device 412 is, for example, a two component developing-type developing device that causes toner of the relevant color component to stick to the surface of photoconductor drum 413 to visualize an electrostatic latent image and thereby form a toner image.

Drum cleaning device 415 includes, e.g., a cleaning member that is in sliding contact with the surface of photoconductor drum 413. Drum cleaning device 415 removes remaining transferred toner remaining on the surface of photoconductor drum 413 after primary transfer, via a cleaning blade.

Intermediate transfer unit 42 includes, e.g., intermediate transfer belt 421, primary transfer rollers 422, a plurality of support rollers 423, secondary transfer roller 424 and belt cleaning device 426.

Intermediate transfer belt 421 is formed of an endless belt and is looped in a tensioned manner around the plurality of support rollers 423. At least one of the plurality of support rollers 423 is formed of a drive roller, and the others are each formed of a driven roller. For example, it is preferable that roller 423A disposed downstream of primary transfer roller 422 for the K component in the belt moving direction be the drive roller. Consequently, a speed of movement of the belt in a primary transfer section can easily be kept constant. Upon rotation of drive roller 423A, intermediate transfer belt 421 moves at a constant speed in the arrow A direction.

Each primary transfer roller 422 is disposed on the inner peripheral side of intermediate transfer belt 421 so as to face photoconductor drum 413 for the relevant color component. A primary transfer nip for transferring a toner image to intermediate transfer belt 421 from photoconductor drum 413 is formed by bringing primary transfer roller 422 into pressure contact with photoconductor drum 413 with intermediate transfer belt 421 interposed therebetween.

Secondary transfer roller 424 is disposed on the outer peripheral surface side of intermediate transfer belt 421 so as to face backup roller 423B disposed downward of drive roller 423A in the belt moving direction. A secondary transfer nip for transferring a toner image to sheet S from intermediate transfer belt 421 is formed by bringing secondary transfer roller 424 into pressure contact with backup roller 423B with intermediate transfer belt 421 interposed therebetween.

The secondary transfer nip formed by intermediate transfer belt 421, backup roller 423B and secondary transfer roller 424 corresponds to the "transfer section" of the present invention.

When intermediate transfer belt 421 passes through the respective primary transfer nips, primary transfer of sequentially superimposing toner images on respective photoconductor drums 413 on intermediate transfer belt 421 is performed. More specifically, a primary transfer bias is applied to each primary transfer roller 422 to provide a side of the intermediate transfer belt 421, the side being brought into abutment with primary transfer roller 422, with charge having a polarity opposite to that of toner, and the relevant toner image is thereby electrostatically transferred to intermediate transfer belt 421.

Subsequently, when a sheet passes through the secondary transfer nip, the toner image on intermediate transfer belt 421 is secondary-transferred onto the sheet. More specifically, a secondary transfer bias is applied to secondary transfer roller 424 to provide a side of the sheet, the side being brought into abutment with secondary transfer roller 424, with charge having a polarity opposite to that of toner, and the toner image is thereby electrostatically transferred to the sheet. The sheet with the toner image transferred thereon is conveyed toward fixing section 60.

Belt cleaning device 426 includes, e.g., a belt cleaning blade that is in sliding contact with the surface of intermediate transfer belt 421, and removes remaining transferred toner remaining on the surface of intermediate transfer belt 421 after secondary transfer.

Fixing section 60 includes, e.g., upper fixing section 60A including a fixing-side member disposed on the fixing side of a sheet, lower fixing section 60B including a back-side support member disposed on a side of the sheet, the side being opposite to the fixing side of the sheet, and heating source 60C. As a result of the back-side support member being brought into pressure contact with the fixing-side member, a fixing nip that sandwiches and conveys a sheet is formed.

Fixing section 60 fixes a toner image to a sheet by heating, and applying pressure to, the sheet that is being conveyed, the sheet being subjected to secondary transfer of the toner image thereto, via the fixing nip. Fixing section 60 is disposed as a unit inside fixing device F.

Sheet conveying section 50 includes, e.g., sheet feeding section 51, sheet ejection section 52 and conveyance pathway section 53. Sheets S sorted based on e.g., basis weights (toughnesses) or sizes (standardized sheets or special sheets) are stored in three sheet feed tray units 51*a* to 51*c* forming sheet feeding section 51, by predetermined type. Conveyance pathway section 53 includes, e.g., a plurality of conveyance rollers such as registration roller pair 53*a* and loop rollers 53*b* and a double-side conveyance pathway for forming an image on each of both side of a sheet. Registration roller pair 53*a* corresponds to the "displacement rollers" of the present invention.

Registration roller pair 53*a* corrects a position in a width direction of sheet S under the control of control section 100. More specifically, upon sheet S being sandwiched by a nip of registration roller pair 53*a*, registration displacement control to move registration roller pair 53*a* in the width direction to move sheet S is performed, and the position in the width direction of sheet S is thereby corrected. The content of such registration displacement control will be described later.

Loop rollers 53*b* form a roller pair disposed upstream of registration roller pair 53*a* in the conveyance direction. Loop rollers 53*b* rotate so as to form a loop in sheet S between loop rollers 53*b* and registration roller pair 53*a* under the control of control section 100, to correct a skew of sheet S.

Paired registration rollers 53*a* are moved away from each other and returned to a position before the movement, after correction of the position in the width direction of sheet S but before sheet S completely passing through registration roller pair 53*a*, that is, during conveyance of sheet S. Then, paired registration rollers 53*a* are brought into pressure contact with each other again after a rear end of sheet S passing through registration roller pair 53*a*.

Also, a speed of conveyance of sheet S in registration roller pair 53*a* is set to be higher than a speed of conveyance of sheet S in the secondary transfer nip formed by backup roller 423B and secondary transfer roller 424, under the control of control section 100.

Line sensor 54 is disposed downstream of registration roller pair 53*a* but upstream of the secondary transfer nip in the sheet conveyance direction. Line sensor 54 is a sensor including photoelectric conversion elements arranged linearly and assumes a role in detecting one end part in the width direction (hereinafter referred to as "side end") of sheet S to detect leaning (deviation from a reference position) of sheet S.

Sheets S stored in each of sheet feed tray units 51*a* to 51*c* are fed out one by one from an upper most part, and conveyed to image forming section 40 by conveyance pathway section 53. Here, an inclination of fed sheet S is corrected (skew correction) and a conveyance timing is adjusted by registration roller pair 53*a*.

Then, in image forming section 40, toner images on intermediate transfer belt 421 are collectively secondary-transferred to one side of sheet S, and a fixing process is performed in fixing section 60. Sheet S with the image formed thereon is ejected to the outside of the apparatus by sheet ejection section 52 including sheet ejection rollers 52*a*. In double-sided printing, sheet S with an image formed on a first side thereof is reversed through the double-side conveyance pathway and a toner image is secondary-transferred and fixed to a second side, and sheet S is then ejected to the outside of the apparatus by sheet ejection section 52.

An image forming apparatus has the problem of occurrence of a phenomenon of a sheet conveyance direction being skewed (sub-scanning directional skew) due to misalignment occurring in a part from registration roller pair 53*a* to the fixing nip through the secondary transfer nip. In addition to the aforementioned misalignment, such sub-scanning skew is also likely to occur where there is a difference in diameter between opposite ends in the sheet width direction of a roller due to, e.g., wear. Also, an elongated sheet that is long in a conveyance direction is susceptible to the above effects, and thus, a sub-scanning skew prominently occurs. Such sub-scanning skew causes a defective image due to, e.g., misregistration or distortion of an image transferred by the transfer section, and thus there is a demand for a technique that suppresses sub-scanning skew.

Figure 10A:
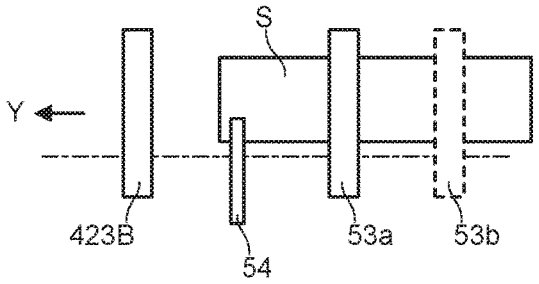
FIGS. 10A and 10B are diagrams illustrating conventional registration displacement control.
Figure 10B:
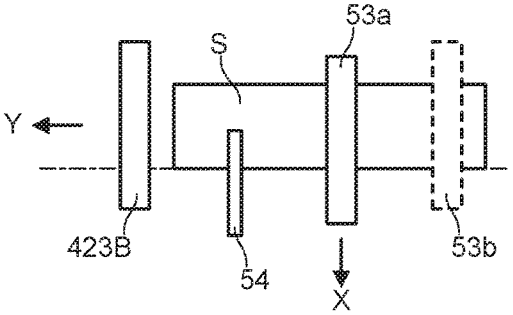

FIGS. 10A and 10B are diagrams for illustrating conventional registration displacement control, and arrow Y denotes a conveyance direction of sheet S, the alternate long and short dash line denotes a reference end position (target position) for sheet S detected by line sensor 54, and arrow X denotes a displacement direction of registration roller pair 53*a*. Also, the dotted line denotes rollers in a state in which the rollers are moved away from sheet S.

FIG. 10A indicates an example in which sheet S (elongated sheet) is conveyed in a state in which entire sheet S is deviated to the right side (far side) upstream of backup roller 423B forming the secondary transfer nip. In this case, control section 100 detects a direction and an amount of deviation of a side end of sheet S from an output signal from line sensor 54 and determines a direction of displacement of registration roller pair 53*a* and calculates an amount of the displacement from a result of the detection. Then, as illustrated in FIG. 10B, control section 100 performs control to displace registration roller pair 53*a* in an X direction orthogonal to a sheet conveyance direction Y according to results of the determination and the calculation.

Also, in order to perform such registration displacement control, control section 100 performs control to move rollers upstream of registration roller pair 53*a* in the conveyance direction (loop rollers 53*b* in the example in FIGS. 10A and 10B) away from sheet S. Therefore, during a time period around the time of displacement of registration roller pair 53*a*, sheet S is conveyed by registration roller pair 53*a* alone.

On the other hand, in such conventional registration displacement control technique, registration roller pair 53*a* may be displaced larger than an amount of displacement determined (calculated) or registration roller pair 53*a* may fail to accurately stop at a targeted position at an end of the displacement because of a mechanical or control error. In this case, excessive displacement of registration roller pair 53*a*, what is called "overrun", occurs, and for example, in the case indicated in FIGS. 10A and 10B, registration roller pair 53*a* is moved to the left side relative to the position indicated in FIG. 10B, and thus, the side end of sheet S deviates to the left side from the reference end (target position) indicated by the alternate long and short dash line. As described above, upon occurrence of excessive displacement of registration roller pair 53*a* in registration displacement (overrun), an operation of moving an end part of a sheet deviated in a width direction to a desired position cannot be performed, and thus, a sub-scanning skew cannot properly be corrected, which causes generation of a defective image.

As a result of a diligent study to solve such problem, the present inventors found that excessive displacement (overrun) can be prevented or suppressed by making a displacement speed of registration roller pair 53*a* be lower than those of the conventional techniques. However, where a displacement speed of registration roller pair 53*a* is low, if an amount of deviation of the side end of sheet S is large, that is, if an amount of displacement of registration roller pair 53*a* is large, a sub-scanning skew cannot completely be corrected, which may result in generation of a defective image. Furthermore, from the perspective of enhancement in productivity of printing in recent years, it is desirable that the displacement speed of registration roller pair 53*a* be as high as possible, in other words, the side end of sheet S be brought close to the target position as soon as possible from a start of displacement of registration roller pair 53*a*.

In view of such actual circumstances, in registration displacement control according to the present embodiment, after the start of displacement of registration roller pair 53*a*, control to decrease (lower) the displacement speed of the registration roller pair 53*a* at a position short of a position at which a side end of sheet S reaches the target position (speed change position). In other words, in an operation of displacement of registration roller pair 53*a* in a direction in which the side end of sheet S approaches the target position, control section 100 controls the displacement of registration roller pair 53*a* in such a manner that registration roller pair 53*a* is displaced at high speed until registration roller pair 53*a* reaches the speed change position from the operation start position and registration roller pair 53*a* is displaced at low speed after reaching the speed change position. Then, in the low-speed displacement operation, upon the side end of sheet S reaching the target position, control section 100 stops displacement of registration roller pair 53*a*.

The content of the registration displacement control in the present embodiment will be described below in more detail with reference to FIGS. 11 and 12.

Figure 11:
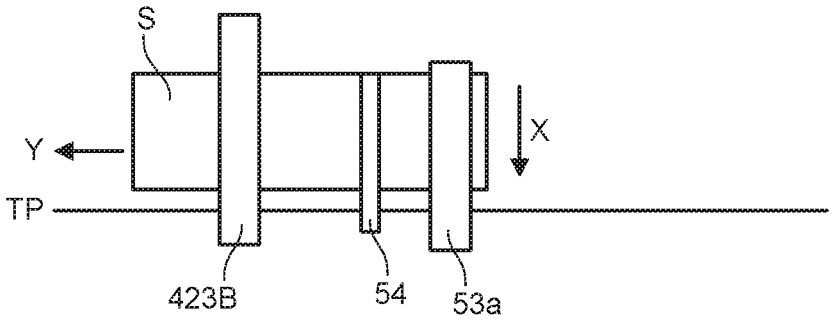
FIG. 11 is a diagram illustrating a content of registration displacement control in Embodiment 2 and is a diagram illustrating an overview of a displacement operation of a registration roller pair.

FIG. 11 is a diagram for describing the content of registration displacement control in the present embodiment, in which arrow Y denotes a conveyance direction of sheet S, a solid line denotes a reference end position (target position TP) for a sheet detected by line sensor 54, and arrow X denotes a displacement direction of registration roller pair 53*a* and sheet S. In FIG. 11, an example case where entire sheet S (elongated sheet) is deviated to the right side (far side) after entering backup roller 423B forming the secondary transfer nip is assumed.

Figure 12:
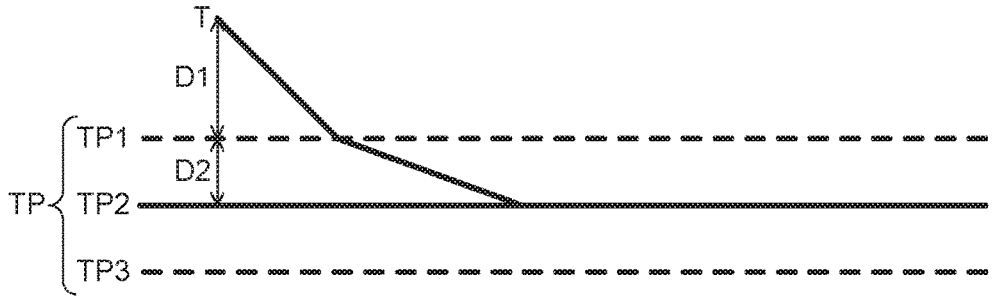
FIG. 12 is a diagram illustrating a detail of the displacement operation of the registration roller pair in the case in FIG. 11.

FIG. 12 is a diagram for describing details of a displacement operation of registration roller pair 53*a* in the example case in FIG. 11, and solid line TP2 denotes a reference end position (second target position) for sheet S detected by line sensor 54. Also, dotted lines TP1 and TP3 are speed change positions for registration roller pair 53*a*, which are set on the right and the left of second target position TP2, respectively, and hereinafter are each also referred to as "first target position". In FIG. 12, the abscissa axis denotes passage of time, and polygonal line T denotes change in speed of registration roller pair 53*a* and a track of a side end of sheet S.

In the present embodiment, in advance to a displacement operation of registration roller pair 53*a*, first target positions TP1 and TP3, which are positions of change of the displacement speed of registration roller pair 53*a*, are set, the positions being short of second target position TP2, which is the reference end position for sheet S. Here, a distance between second target position TP2 and first target position TP1 (TP3) only needs to be a value that is smaller than an amount of deviation of a side end of sheet S. Therefore, the distance between second target position TP2 and first target position TP1 (TP3) may be a quantitative amount (fixed value) or a qualitative amount (variable value) as long as such quantitative amount or such qualitative amount has a value that is smaller than an amount of deviation of a side end of sheet S.

On the other hand, from the perspective of maximum enhancement in productivity of printing, it is desirable that distance (that is, displacement amount) D1 from a displacement start position of registration roller pair 53*a* to first target position TP1 (TP3), which is a speed change position, be set to be larger than distance (displacement amount) D2 from first target position TP1 (TP3) to the final target position (second target position TP2).

A case where it is presumed that a direction and an amount of deviation of sheet S cannot be estimated and control section 100 detects a direction and an amount of deviation of sheet S using line sensor 54 and displaces registration roller pair 53*a* based on a result of the detection will be described below.

In this case, as illustrated in FIG. 12, control section 100 sets first target positions (TP1, TP3), in a manner, virtually on the opposite, right and left, sides of second target position TP2, which is a final target position. Here, a distance between second target position TP2 and first target position TP1 (TP3) may be set to have a value (variable value) obtained by multiplying the amount of deviation of sheet S by a coefficient.

In one example, where the coefficient is 0.2 and the amount of deviation of sheet S is 1 mm, the distance between second target position TP2 and first target position TP1 (TP3) is $1\times0.2=0.2$ mm. In this case, control section 100 performs control so that registration roller pair 53*a* is displaced at high speed up to 0.8 mm from a start of the displacement, and the displacement speed of registration roller pair 53*a* is then changed to be a low speed to displace registration roller pair 53*a* at low speed for 0.2 mm up to second target position TP2.

The aforementioned value relating to the distance between second target position TP2 and first target position TP1 (TP3), and a value relating to the difference in displacement speed between before and after first target position TP1 (TP3) being reached are registered in a non-illustrated table (hereinafter, referred to as "operation table") as initial values. Then, at the time of execution of a print job, control section 100 reads the respective values registered in the operation table to perform registration displacement control.

In the present embodiment, as a result of such registration displacement control being performed, the displacement speed of registration roller pair 53*a* becomes low at a position short of a position at which a side end of sheet S reaches the target position (second target position TP2), and thus, excessive displacement (overrun) of registration roller pair 53*a* can be prevented.

Furthermore, in the present embodiment, registration roller pair 53*a* is displaced at high speed up to first target position TP1 (TP3), enabling productivity in printing. Generally, the present embodiment in which a speed change position is used as what is called "threshold value" and the displacement speed of registration roller pair 53*a* is decreased with the speed change position as a borderline enables preventing excessive displacement (overrun) of registration roller pair 53*a* while ensuring productivity in printing.

In the present embodiment, control section 100 monitors whether or not there is deviation of sheet S from the reference position (second target position TP2) even after sheet S entering backup roller 423B, using line sensor 54. Therefore, in the example case in FIG. 11, control section 100 detects a direction and an amount of deviation of a side end of sheet S from an output signal from line sensor 54, determines a displacement direction of registration roller pair 53*a* from a result of the detection and calculates an amount of displacement.

Then, as illustrated in FIG. 11, control section 100 controls a drive section (e.g., a motor) for registration roller pair 53*a* so that registration roller pair 53*a* starts displacement at high speed in a direction in which the side end of sheet S approaches target position TP (leftward in this example), according to the determination and the calculated value.

Subsequently, as illustrated in FIG. 12, upon a displacement amount (movement amount) from the start of displacement of registration roller pair 53*a* reaching into distance D1, control section 100 performs control to decrease the displacement speed of registration roller pair 53*a*. Here, distance D1 corresponds to a distance until the side end of sheet S reaches first target position TP1 after the start of displacement of registration roller pair 53*a* (that is, an amount of displacement up to the first target position).

Furthermore, as illustrated in FIG. 12, upon a displacement amount (movement amount) of registration roller pair 53*a* from first target position TP1 reaching into distance D2, control section 100 performs control to stop the displacement of registration roller pair 53*a*. Here, distance D2 corresponds to a distance until the side end of sheet S reaches second target position TP2, which is the final target position (reference position) from first target position TP1 (that is, an amount of displacement from first target position TP1 to second target position TP2). In other words, a value that is a sum of distance D1 and distance D2 is an amount of deviation of the side end of sheet S.

Also, when control section 100 stops registration roller pair 53*a*, control section 100 may use a detection signal from line sensor 54. In this case, control section 100 stops registration roller pair 53*a* based on an actual position of a side end of sheet S, and thus, the side end of sheet S can more accurately be stopped at second target position TP2. Such control is particularly effective, for example, in a situation in which sheet S easily slips relative to registration roller pair 53*a*. Examples of the situation in which sheet S easily slips relative to registration roller pair 53*a* include a case where an elongated sheet that is long in the conveyance direction such that the front end side or the rear end side of sheet S is pressed by, e.g., rollers other than registration roller pair 53*a* as well, for example, an elongated sheet having a length exceeding 487.7 mm is fed. In such case, a sheet feeding apparatus dedicated to elongated sheets (not illustrated) is connected to image forming apparatus 1 to convey sheets S, and during the conveyance, the rear end side of the elongated sheet is brought into pressure contact with sheet feeding rollers of the sheet feeding apparatus, and during registration displacement, sheet S easily slips relative to registration roller pair 53*a*.

FIG. 11 indicates an example case where sheet S is an elongated sheet. However, registration displacement control according to the present embodiment can be applied regardless of the length in the conveyance direction of sheet S, and thus can be applied to standardized sheets such as A4-size sheets. More specifically, from among the standardized sheets, in the case of sheets that can easily bent upon conveyance, for example, thin sheets, excessive displacement (overrun of a side end of a sheet) relatively more likely to occur, and thus, the registration displacement control according to the present embodiment may be employed.

However, in general, since as sheet S is longer in the conveyance direction, a degree (amount) of deviation of a side end of sheet S from second target position TP2 tends to be larger, the registration displacement control according to the present embodiment is particularly effective for a case where a sub-scanning skew of an elongated sheet is to be corrected.

FIG. 11 indicates a case where since sheet S deviates rightward, registration roller pair 53*a* is displaced leftward. For a case opposite to this case, that is, a case where since sheet S deviates leftward, registration roller pair 53*a* is displaced rightward, control similar to the above may be performed using first target position TP3.

In the above-described configuration, optimum values of a distance from first target position TP1 (or TP3) to second target position TP2 (point at which a speed of displacement of registration roller pair 53*a* is switched from a high speed to a low speed) and an amount of the speed decrease when the speed of displacement of registration roller pair 53*a* is switched from a high speed to a low speed may vary depending on the image forming condition.

In other words, these optimum values may vary depending on, e.g., the types (for example, a basis weight (toughness), a size, recycled paper or not, etc.) of sheets S, and/or an ambient hygrothermal environment of image forming apparatus 1.

Therefore, a plurality of the above-described operation tables may be provided according to sheet feeding conditions (image forming conditions) such as types of sheets S and/or hygrothermal environments so as to be capable of registering different values in the respective operation tables. In this case, at the time of execution of a print job, control section 100 specifies image forming conditions with reference to, e.g., user setting information and/or an output of an internal thermo-hygro sensor, and reads values set in the operation tables for the specified image forming conditions to perform the above-described registration displacement control.

In addition, a configuration in which the distance from first target position TP1 (TP3) to second target position TP2, in other words, a low-speed zone in which registration roller pair 53*a* is displaced at low speed, can arbitrarily be selected may be employed. As a specific example, selection of "precision prioritized" or "productivity prioritized" can be made through, e.g., a non-illustrated user setting screen. Then, in registration displacement control, with reference to such setting, control section 100 employs a correction value (correction coefficient) so as to, if "precision prioritized" is set, widen the low-speed zone, and if "productivity prioritized" is set, narrow the low-speed zone, to control displacement of registration roller pair 53*a* in such a manner as above.

Alternatively, control section 100 may automatically set (generate) or modify (update) the above-described operation tables by performing control in an adjustment mode such as below.

In this adjustment mode, control section 100 turns line sensor 54 on and causes only a predetermined number of (for example, 20) sheets S of a same type to be fed to the secondary transfer nip and fixing section 60. At this time, control section 100 controls the respective sections so as to feed each sheet S, for example, in a state of a blank sheet with a coverage of 0% or form a toner image for test on each sheet S.

Here, if no operation table for a relevant image forming condition (e.g., a type of sheets S) is provided, control section 100 records results of detection of feeding of the predetermined number of (20) sheets S by line sensor 54 (that is, an amount of deviation of a side end of each sheet S being fed from the reference position) without performing registration displacement control. Then, control section 100 aggregates the recorded detection results (amounts of deviation of sheets S), determines values for first target position TP1 and a displacement speed decrease amount according to a result of the aggregation, and creates a new operation table in which these values are registered.

On the other hand, if an operation table for, e.g., the type of sheets S is provided, control section 100 performs registration displacement control according to values registered in the operation table, and records results of detection of feeding of the predetermined number of (20) sheets S by line sensor 54. Then, control section 100 aggregates the recorded detection results (amounts of deviation of sheets S) and updates the operation table so as to modify the values for first target position TP1 (TP3) and the displacement speed decrease amount according to a result of the aggregation, as necessary.

As a result of such automatic adjustment control, the values for first target position TP1 (TP3) and the displacement speed decrease amount can be made to be values set in consideration of, e.g., a process of assembly of image forming apparatus 1, variations in mechanical checks conducted by a maintenance person at the time of adjustment work after delivery of image forming apparatus 1 and/or an idiosyncrasy particular to the relevant apparatus.

An example of operation relating to displacement control for registration roller pair 53*a*, thus, sheet S in image forming apparatus 1 will be described with reference to the flowchart in FIG. 13.

Figure 13:
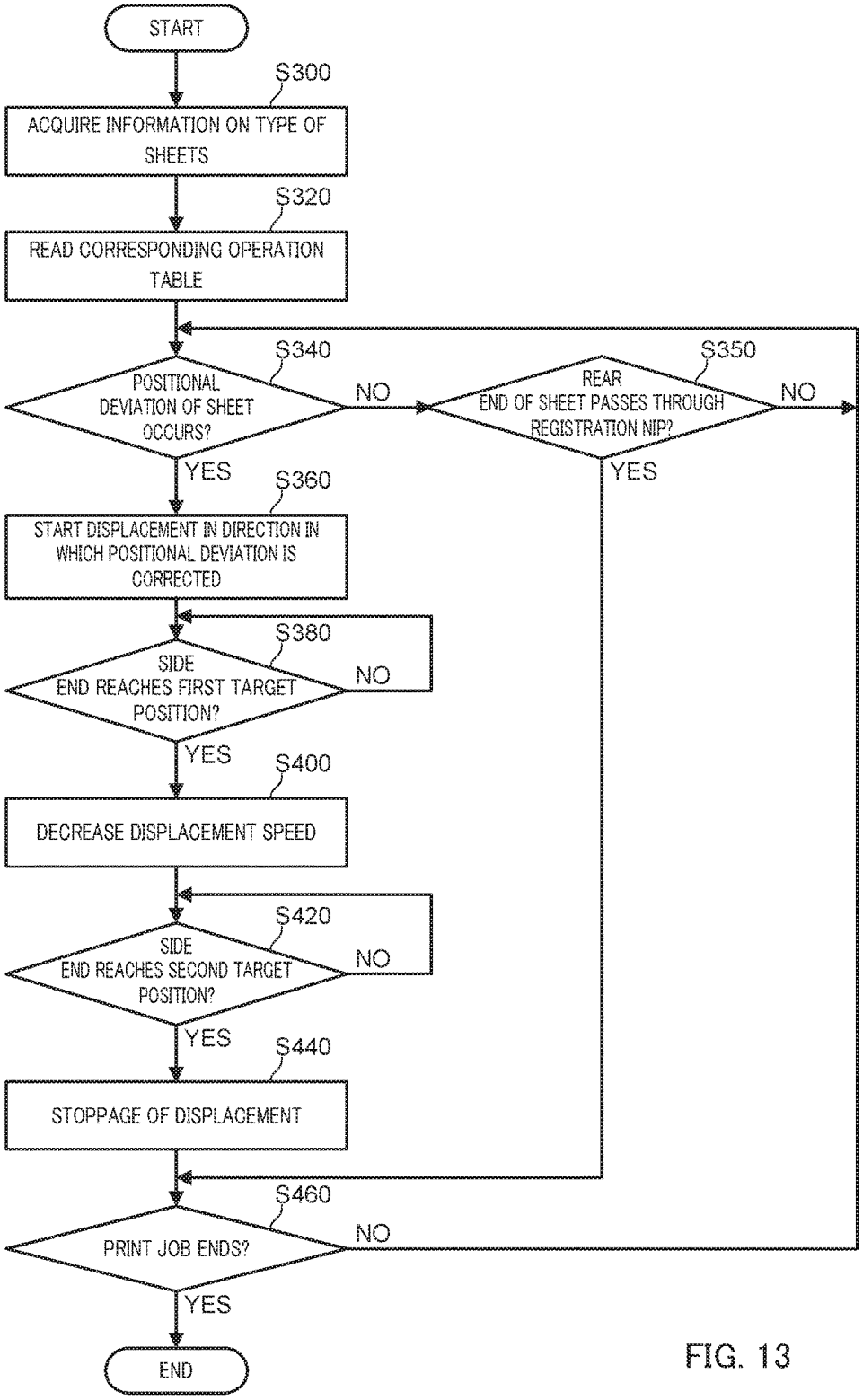
FIG. 13 is a flowchart illustrating an example of conveyance control for registration displacement in the image forming apparatus according to Embodiment 2.

In the example illustrated in FIG. 13, displacement of registration roller pair 53*a* is controlled using an operation table in which values for first target position TP1 (TP3), which is a speed change position, and a speed decrease amount are set. In this example, for a value of first target position TP1 set in the operation table, a constant to be added to an amount of positional deviation of sheet S as a value indicating a distance from the reference position (second target position TP2) to first target position TP1 (TP3) is provided. Also, in this example, a constant to be added to a displacement start speed of registration roller pair 53*a* is provided as a value of a speed decrease amount provided in the operation table.

At the time of execution of a print job, control section 100 acquires information on the type of sheets S to be printed (basis weight (toughness), recycled paper or not, size, etc.), from user setting information for the print job (step S300).

In step S320, control section 100 reads values registered in the operation table for the obtained image forming condition (sheet type in this example) and sets a value for first target positions TP1 and TP3 (speed change positions) (for example, a coefficient of 0.2) and a value for a speed decrease amount (for example, a coefficient of 0.5) in, e.g., a memory in advance.

Control section 100 activates line sensor 54 at a timing after a front end in the conveyance direction of sheet S entering registration roller pair 53*a* to detect a position of a side end of sheet S, and determines whether or not positional deviation of sheet S occurs (step S340). Here, control section 100 determines whether or not a positional deviation of sheet S occurs, according to whether or not the side end of sheet S deviates from the reference position (that is, the second target position TP2).

If control section 100 determines that no positional deviation of the side end of sheet S occurs (NO in step S340), control section 100 determines whether or not a rear end in the conveyance direction of sheet S passes through the registration nip formed by registration roller pair 53*a* (step S350). Here, control section 100 repeats determination of whether or not positional deviation of sheet S occurs, while the rear end of sheet S does not pass through the registration nip (NO in step S350, and step S340), and if control section 100 determines that positional deviation of sheet S occurs (YES in step S340), control section 100 proceeds to step S360.

In step S360, control section 100 identifies a direction and an amount of the positional deviation of the side end of sheet S and outputs a control signal to the drive section (e.g., a motor) that drives registration roller pair 53*a* so as to start displacement of registration roller pair 53*a* in a direction in which the positional deviation of sheet S is corrected. Here, registration roller pair 53*a* starts the displacement in a width direction at high speed, while sandwiching sheet S therebetween. With the start of the displacement, the side end of sheet S moves so as to approach the reference position (that is, second target position TP2).

Subsequently, control section 100 determines whether or not the side end of sheet S reaches first target position TP1 (or TP3) (step S380), and continues the high-speed displacement of registration roller pair 53*a* until control section 100 determines that the side end of sheet S reaches first target position TP1 (NO in step S380). On the other hand, control section 100 determines that the side end of sheet S reaches first target position TP1 (or TP3) (YES in step S380), and proceeds to step S400.

More specifically, control section 100 determines whether or not the side end of sheet S reaches first target position TP1 (TP3), according to whether or not registration roller pair 53*a* is displaced (moved in the width direction) by the "amount of the positional deviation of sheet S×0.2" from the start of displacement in step S360. In other words, if control section 100 determines that registration roller pair 53*a* is displaced by the amount of the positional deviation of sheet S×0.2, control section 100 regards the side end of sheet S as reaching first target position TP1 (TP3) and proceeds to step S400.

In step S400, control section 100 outputs a control signal to, e.g., the motor that drives registration roller pair 53*a*, so as to decrease the displacement speed of registration roller pair 53*a* that is being displaced at high speed. In this example, as a result of employment of a speed decrease amount of 0.5, the displacement speed of registration roller pair 53*a* is decreased to a low speed that is half of the displacement speed.

In subsequent step S420, control section 100 drives line sensor 54 to detect a position of the side end of sheet S, and determines whether or not the side end of sheet S reaches second target position TP2 (reference position), based on a result of the detection.

Then, control section 100 continues the low-speed displacement operation while the side end of sheet S does not reach second target position TP2 (NO in step S420), and if control section 100 determines that the side end of sheet S reaches second target position TP2 (YES in step S420), control section 100 proceeds to step S440.

In step S440, control section 100 outputs a control signal to, e.g., the motor that drives registration roller pair 53*a*, so as to stop the displacement of registration roller pair 53*a*.

As a result of such control, the side end of sheet S can correctly be aligned with second target position TP2, which is the reference position, and thus, a sub-scanning skew of the sheet can more correctly be corrected.

In step S460, control section 100 determines whether or not the print job ends. As a result of the determination, if the print job does not end (NO in step S460), control section 100 returns to step S340 and continues determination of whether or not positional deviation of sheet S occurs, until the rear end of sheet S passes through the registration nip (NO in step S350, and step S340). Therefore, in the example control, registration displacement can be performed a plurality of times for one sheet S.

Also, if control section 100 determines that the rear end of sheet S passes through the registration nip (YES in step S350), control section 100 proceeds to step S460, and if there is next sheet S to be subjected to printing, control section 100 regards the print job as not ending (NO in step S460) and returns the processing to step S340. Therefore, in this example, registration displacement can be performed under a same setting condition while printing of a toner image on each of a plurality of sheets S being performed.

Then, if control section 100 determines that the print job ends (YES in step S460), control section 100 ends the above-described series of processing.

As described above, according to the present embodiment, registration roller pair 53*a* is displaced in two steps that are a high-speed operation from a start of the displacement (initial operation) to first target position (TP1 or TP3) and a low-speed operation from first target position (TP1 or TP3) to second target position TP2, enabling correction of positional deviation of sheet S while achieving both productivity in printing and excessive displacement prevention.

Also, according to the present embodiment, control to stop displacement of registration roller pair 53*a* is performed based on a result of detection of a side end of sheet S by line sensor 54, enabling accurate alignment of the side end of sheet S with a desired position.

Generally, according to the present embodiment, a sub-scanning skew of a sheet can more accurately corrected in comparison with conventional registration displacement control, a sub-scanning skew of sheet S attributable to, e.g., misalignment and/or a difference in diameter of each of rollers in width direction can be corrected, and consequently, occurrence of, e.g., misregistration of an image attributable to sub-scanning skew can be prevented. Therefore, according to the present embodiment, a sub-scanning skew of sheet S can more accurately be corrected in comparison with conventional control, that is, generation of a defective image can effectively be prevented.

The above example configuration has been described in terms of a case where respective operation tables for setting operations of registration roller pair 53*a* are provided according to, e.g., types of sheets S and/or hygrothermal environments. As another example, settings can be made to be selected via, e.g., a non-illustrated user setting screen so as not to perform the above-described displacement operation (change in displacement speed) of registration roller pair 53*a*, depending on, e.g., the type of sheet S or the hygrothermal environment. For example, a condition in which excessive displacement of registration roller pair 53*a* or a side end of sheet S is less likely to occur is registered in advance, and under such condition, control section 100 performs registration displacement control to displace (move) registration roller pair 53*a* at a constant displacement speed and stop registration roller pair 53*a* at second target position TP2.

Alternatively, as another example, settings can be made to be selected via, e.g., a non-illustrated user setting screen so as not to perform the above-described displacement operation (change in displacement speed) of registration roller pair 53*a*, depending on the amount of operation of registration roller pair 53*a* (amount of deviation of the side end of the sheet from second target position TP2). Alternatively, a value of an operation amount (e.g., an amount of deviation of a side end of sheet S) in which excessive displacement of registration roller pair 53*a* or a side end of sheet S is less likely to occur is registered in advance, and in the case of such value, control section 100 performs registration displacement control to displace (move) registration roller pair 53*a* at a constant displacement speed and stop registration roller pair 53*a* at second target position TP2.

Alternatively, regardless of the content of the settings above, control section 100 may be made to, if an amount of displacement of registration roller pair 53*a*, that is, an amount of positional deviation of a side end of sheet S, is equal to or lower than a threshold value, displace registration roller pair 53*a* at low speed from the beginning, without performing the determination in step S380. Such threshold value can be set in advance or adjusted through, for example, a user setting screen or the like.

For simplicity, the example configuration has been described on the premise that second target position TP2 is the same as a fixed position, that is, a reference end position for sheet S detected by line sensor 54 (see the alternate long and short dash line in FIGS. 10A and 10B). However, second target position TP2 does not necessarily need to be the same as the reference end position. For example, where sheet S easily slips relative to registration roller pair 53*a*, there may be a case where it is favorable to set a relatively large displacement amount for registration roller pair 53*a*. Therefore, a value relating to second target position TP2, for example, a value of a difference from a reference end position for sheet S (alternate long and short dash line in FIGS. 10A and 10B) may be registered in the above-described operation table.

For simplicity, the above example configuration has been described in terms of a case where respective distances from first target positions TP1 and TP3 to second target position TP2 are set to be equal to each other. However, respective distances from first target positions TP1 and TP3 to second target position TP2 may be set to be different from each other according to, e.g., an idiosyncrasy particular to the apparatus. In this case, a value for first target position TP1 on the right side of second target position TP2 and a value for first target position TP3 on the left side of second target position TP2 are registered, respectively, in the above-described operation table.

In addition, in the above-described adjustment mode, the aforementioned value of the difference from second target position TP2 (reference end position for sheet S (alternate long and short dash line in FIGS. 10A and 10B) and the values of first target positions TP1 and TP3 on the right and left sides of second target position TP2 may be adjusted.

The above example configuration has been described in terms of a case where control section 100 identifies a direction and an amount of positional deviation of a side end of sheet S using line sensor 54 and starts displacement of registration roller pair 53*a*. However, where a direction and an amount of positional deviation of a side end of sheet S are known in advance (can be estimated) because of, e.g., an idiosyncrasy particular to the apparatus, in step S360, control section 100 may start displacement of registration roller pair 53*a* without using a result of detection by line sensor 54. In this case, a timing or a position on sheet S (displacement point) for starting displacement of registration roller pair 53*a*, a displacement direction and a displacement amount are set in advance as fixed values (present values). Then, control section 100 reads the respective values set as preset values out onto, e.g., a memory, for example, prior to the start of displacement in step S360 and sets the values, and then performs the processing in step S360 onwards according to the set values.

The above example configuration has been described in terms of a case where registration roller pair 53*a* is displaced both before and during transfer of an image by the secondary transfer nip. However, in the present embodiment, displacement of registration roller pair 53*a* may be performed only before transfer of an image by the secondary transfer nip or may be performed only during transfer of an image by the secondary transfer nip. Also, in a case where preset values are used such as above, displacement of registration roller pair 53*a* is performed during an arbitrary period of time after a front end of sheet S entering the registration nip, according to the timing set in the preset values.

[Supplement]

According to Embodiment 2 described above, the technical ideas and configurations stated in (1) to (11) below can be derived.

(1) Control section 100 decreases a speed of displacement of a sheet conveyance member (registration roller pair 53*a*, and the same applies to the below) at a position short of a position at which an end part of sheet S reaches a target position, and upon the end part of sheet S reaching the target position, control section 100 stops the displacement of the sheet conveyance member (53*a*).

(2) In the configuration in (1) above, control section 100 sets a speed change position prior to the displacement of the sheet conveyance member (53*a*), and upon the end part of sheet S reaching the speed change position, control section 100 decreases the speed of the displacement of the sheet conveyance member (53*a*).

(3) In the configuration in (2) above, control section 100 controls the displacement of the sheet conveyance member (53*a*) using a table in which a value relating to the speed change position is registered.

(4) In the configuration in (3) above, a value relating to a target position is registered in the table.

(5) In the configuration in (3) or (4) above, a value of the speed of displacement of the sheet conveyance member (53*a*) is registered in the table.

(6) In the configuration in (3) or (4) above, control section 100 generates or updates the table according to a result of detection by a detection section (line sensor 54, and the same applied to the below) that detects an end part in a width direction of sheet S, the detection section being disposed between a transfer section and the sheet conveyance member (53*a*).

(7) In the configuration in any of (3) to (6) above, the table is provided according to a type of sheet S.

(8) In the configuration in any of (3) to (7) above, the table is provided according to a temperature and a humidity around the image forming apparatus.

(9) In the configuration in any of (1) to (8) above, based on a position of an end part in a width direction of sheet S, the position being detected by the detection section (54) that detects the position of the end part during displacement operation of the sheet conveyance member (53*a*), control section 100 stops the displacement when the end part of sheet S reaches the target position.

(10) In the configuration in (2) above, control section 100 sets the speed change position in such a manner that a distance from a displacement start position of the sheet conveyance member (53*a*) to the speed change position is larger than a distance from the speed change position to the target position.

(11) In the configuration in any of (1) to (10) above,

If an amount of displacement of the sheet conveyance member (53*a*) is equal to or below a threshold value, control section 100 starts displacement of the sheet conveyance member (53*a*) with the displacement speed decreased.

Embodiment 3

An image forming apparatus according to Embodiment 3 will be described in detail with reference to the drawings. An overall configuration of the image forming apparatus and a major part of a control system in Embodiment 3 are the same as those of Embodiment 2 described above, and thus, illustration and description thereof will be omitted.

In registration displacement control in Embodiment 3, in an operation of displacing registration roller pair 53*a* in a positive direction in which a side end of sheet S moves toward a target position, registration roller pair 53*a* is caused to vibrate to opposite sides in a width direction. In other words, in an operation of displacing registration roller pair 53*a* in a positive direction in which a side end of sheet S moves toward a target position, control section 100 performs control so as to repeat movement in the positive direction of registration roller pair 53*a* and movement in a negative direction of registration roller pair 53*a*, the negative direction being opposite to the positive direction, to bring the side end of sheet S close to the target position.

The registration displacement control in Embodiment 3 will be described in detail below with reference FIGS. 14 and 15.

Figure 14:
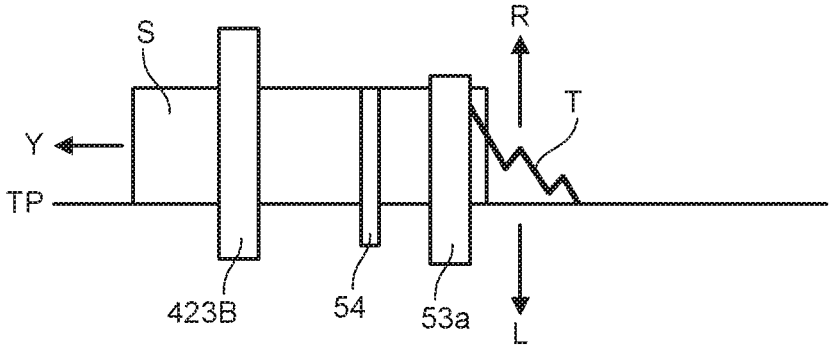
FIG. 14 is a diagram illustrating an overview of a displacement operation of a registration roller pair in Embodiment 3.
Figure 15A:
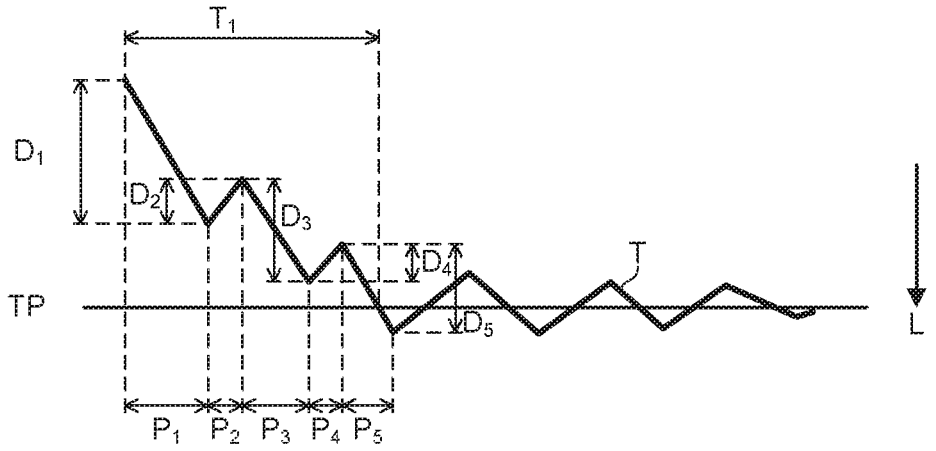
FIGS. 15A and 15B are diagrams each illustrating the content of registration displacement control in Embodiment 3.
Figure 15B:
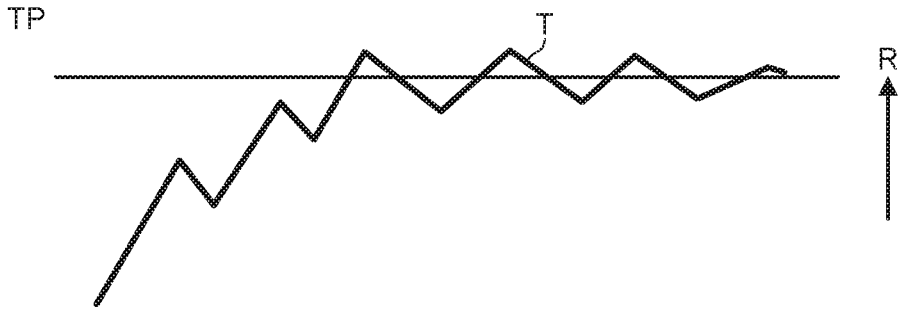

FIGS. 14, 15A and 15B schematically illustrate examples of a displacement operation of registration roller pair 53*a* during registration displacement in the present embodiment. In the respective drawings, a solid line denotes target position TP for a side end of sheet S, arrow L and arrow R denote directions of movement of registration roller pair 53*a*, and solid line T (hereinafter referred to as track T) denotes a behavior and a track of registration roller pair 53*a* and sheet S during registration displacement.

FIG. 14 illustrates track T of registration roller pair 53*a* and sheet S during registration displacement and a state of sheet S at an end of the registration displacement, and in the figure, arrow Y denotes a conveyance direction of sheet S. More specifically, FIG. 14 illustrates a state in which sheet S deviating rightward is moved leftward (arrow L) by registration displacement and a side end of sheet S is thereby aligned with target position TP, and track T of registration roller pair 53*a* and sheet S in the registration displacement.

In this example, in an operation of displacing registration roller pair 53*a* in a positive direction (L direction in the example in FIG. 14) in which the side end of sheet S moves toward target position TP, control section 100 performs control to repeat (switch between) movement of sheet S in the positive direction and movement of a negative (R) direction opposite to the positive direction to bring the side end of sheet S close to target position TP as illustrated in FIG. 14, rather than moving sheet S in the positive (L) direction alone. In other words, control section 100 controls displacement of registration roller pair 53*a* so as to bring the side end of sheet S close to target position TP while moving (vibrating) registration roller pair 53*a* to opposite, left and right (LR), sides alternately.

In the present embodiment, as a result of such registration displacement control, when the side end of sheet S comes to a position close to the target position TP, what is called a braking effect can be enjoyed, enabling effective prevention or suppression of excessive displacement (overrun) of registration roller pair 53*a*.

Furthermore, even if slightly excessive displacement of registration roller pair 53*a* occurs (see FIG. 15), the present embodiment enables minimization of the excess amount and thus enables prompt resolution of deviation resulting from such excessive displacement.

A displacement operation of registration roller pair 53*a*, etc., will be described in further detail below with reference to FIG. 15.

FIGS. 14 and 15A indicate an example case in which at the time of a start of registration displacement, a side end of sheet S deviates to the right side from target position TP, and indicates a specific example of moving registration roller pair 53*a* to the left (L) side, which is a positive direction. On the other hand, FIG. 15B indicates an example case in which at the time of a start of registration displacement, a side end of sheet S deviates to the left side from target position TP, and indicates a specific example of moving registration roller pair 53*a* to the right (R) side, which is a positive direction. FIGS. 15A and 15B each indicate a case where a slightly excessive displacement occurs.

In the example case in FIGS. 14 and 15A, control section 100 outputs a control signal to bring a side end of sheet S close to target position TP while moving (vibrating) registration roller pair 53*a* to the opposite, left and right (LR), sides alternately, rather than simply moving registration roller pair 53*a* in the arrow L direction (positive direction) alone as described above.

Such control can be achieved by, for example, supplying a current resulting from superimposition of an alternate-current (AC) component on a direct-current component to a drive source (e.g., a motor) that displaces registration roller pair 53*a* or vibrating shafts of paired registration rollers 53*a* to the left and the right using, e.g., a piezoelectric element or a cam.

As a more specific example, as illustrated in FIG. 15A, control section 100 first moves registration roller pair 53*a* by distance $D_1$ in the positive (L) direction and then moves registration roller pair 53*a* by distance $D_2$ in the negative (R) direction. Here, in order to make the side end of sheet S more quickly reach target position TP, distance $D_1$ of movement of registration roller pair 53*a* in the positive direction may be set to be longer than distance $D_2$ of movement of registration roller pair 53*a* in the negative direction. In other words, assuming that respective speeds of movement of registration roller pair 53*a* to the left and the right are the same, the time of movement in the positive (L) direction (period $P_1$) is longer than the time of movement in the negative (R) direction (period $P_2$). Subsequently, likewise, control section 100 performs control to move registration roller pair 53*a* to the opposite, left and right, sides alternately in such a manner that the distance (period) of movement in the positive direction is longer than the distance (period) of movement in the negative direction (see distances $D_3$, $D_4$, $D_5$ and periods $P_3$, $P_4$, $P_5$ in FIG. 15A).

Here, in order to prevent an overrun of registration roller pair 53*a* as much as possible, respective amounts of movement of registration roller pair 53*a* to the left and the right, in particular, the amount of movement in the positive direction, may be made to be smaller (distances $D_1>D_3>D_5$) as the side end of sheet S comes closer to target position TP.

In the example illustrated in FIG. 15A, a case where in third positive (L) direction movement (see distance $D_5$) from the start of the displacement, the side end of sheet S excessively moves to the left relative to target position TP (overrun occurs). Even in this case, as illustrated, it can be seen that the amount of the overrun is suppressed to be small Furthermore, even where such overrun occurs, control section 100 performs control to reduce a width of behavior, that is, vibration of registration roller pair 53*a*, enabling the side end of sheet S to be finally accurately aligned with target position TP (see FIG. 15A).

As an example of control for overrun countermeasure, control section 100 activates line sensor 54 to monitor a position of a side end of sheet S from an output signal from line sensor 54, at proper timings during a period of time from a start of displacement of registration roller pair 53*a* until sheet S reaches target position TP (see period $T_1$ in FIG. 15A). Then, upon the side end of sheet S reaching target position TP, control section 100 outputs a control signal to the drive source for registration roller pair 53*a* so as to stop vibration operation of registration roller pair 53*a*.

Such stoppage control enables registration roller pair 53*a* to be stopped at a more accurate position corresponding to target position TP in comparison with a conventional control method, that is, a method in which before displacement of registration roller pair 53*a*, an amount of deviation of a side end of sheet S is detected using line sensor 54 and registration roller pair 53*a* is displaced by the amount of deviation detected.

Furthermore, in consideration of deviation for a mechanical reason (e.g., backlash) due to wear, in the above displacement stoppage, control section 100 may determine whether or not an overrun of the side end of sheet S occurs, from a result of the detection by line sensor 54. Here, where control section 100 determines that an overrun occurs, for example, control section 100 identifies an amount of the overrun (excessive displacement) and switches the control signal output to the drive source for registration roller pair 53*a* to a signal for vibration reduction (see FIG. 15A). As an example, such signal for vibration reduction is a signal that causes registration roller pair 53*a* to move (vibrate) in both the positive direction and the negative direction and causes the positive and negative movement amounts to be gradually reduced.

FIG. 15B indicates an example in which at a start of registration displacement, a side end of sheet S deviates to the left side relative to target position TP, and in this case, the arrow R (right) direction is a positive direction and the arrow L (left) direction is a negative direction, which is opposite to the example in FIG. 15A. In this case, control section 100 makes a direction of first movement of registration roller pair 53*a* be opposite to the direction in the above, and subsequently, controls displacement of registration roller pair 53*a* so as to bring the side end of sheet S close to target position TP, using a method that is similar to the above.

Such control enable prevention or minimization of excessive displacement (what is called overrun) of registration roller pair 53*a*, for example, even where a displacement speed of registration roller pair 53*a* is set to be high, further, where an amount of deviation of the side end of sheet S from the target position is so large as to largely move registration roller pair 53*a*.

In FIGS. 15A and 15B, it is assumed that the conditions are the same except the directions of deviation of the side end of sheet S from target position TP are opposite to each other (that is, the positive and negative directions are opposite to each other), and respective cases where registration roller pair 53*a* is moved in respective manners similar to each other according to the respective amounts of deviation of the side end. In other words, it can be seen that in terms of track T of registration roller pair 53*a*, the example illustrated in FIG. 15A and the example illustrated in FIG. 15B exhibit forms that are substantially symmetrical to each other. However, a manner of vibrating registration roller pair 53*a* can be set to be different between a case where an end side of sheet S is brought close to target position TP from the left and a case where an end side of sheet S is brought close to target position TP from the right, according to, e.g., an idiosyncrasy of the apparatus.

Also, for simplicity, in each of FIGS. 15A and 15B, track T of registration roller pair 53*a* and sheet S is schematically indicated, and in actual control, as described later, registration roller pair 53*a* can be vibrated in smaller motions.

In the present embodiment, a content of operation in positive and negative directions of registration roller pair 53*a* in displacement control, more specifically, an amplitude (distance of movement) and a period (movement time period) in the positive direction, and an amplitude (distance of movement) and a period (movement time period) in the negative direction, can be set in advance as initial values. Also, such initial values may be changed by a user through, e.g., a non-illustrated user setting screen. With such configuration, a manner of operation of registration roller pair 53*a* when a side end of sheet S is brought close to target position TP (how the side end of sheet S is brought close to target position TP) in displacement control can arbitrarily be set in consideration of, e.g. an idiosyncrasy particular to the apparatus.

However, where registration displacement control is performed using the above-described initial values and/or values set by a user, some margins of error (e.g., excess or deficiency of displacement) may occur depending on, e.g., the type of sheet S (e.g., a size, a basis weight (toughness), glossiness and/or recycled paper or not) and/or the environment such as a temperature and a humidity. Therefore, an amplitude (distance of movement) and a period (time period of movement) in a positive direction, and an amplitude (distance of movement) and a period (time period of movement) in a negative direction, of registration roller pair 53*a* in registration displacement may be set individually as operation setting values according to, e.g., the aforementioned types of sheet S, a temperature and a humidity.

Where contents of operations of registration roller pair 53*a* in registration displacement are individually set as operation setting values as described above, a table with such operation setting values registered therein (hereinafter referred to as "operation table") may be provided according to sheet feeding environments such as types of sheet S and a temperature and a humidity (hereinafter referred to image forming conditions). In this case, control section 100 determines image forming conditions prior to registration displacement control, and controls displacement of registration roller pair 53*a* according to the contents set in the operation table for such conditions. For example, control section 100 acquires information on the type of sheet S from user setting information for a print job. Also, control section 100 acquires values of a temperature and a humidity around image forming apparatus 1, from an internal thermo-hygro sensor (not illustrated).

In the above-described registration displacement control, displacement of registration roller pair 53*a* can be started based on a result of detection of a position of a side end of sheet S by line sensor 54 or displacement of registration roller pair 53*a* may be started without using a result of detection of a position of a side end of sheet S by line sensor 54.

In the case of the former control, control section 100 determines (calculates) a direction and an amount of deviation of the side end of sheet S from a result of detection by line sensor 54, and outputs a control signal to the drive source for registration roller pair 53*a* to cause registration roller pair 53*a* to make a favorable displacement (vibration) operation corresponding to a result of the determination (calculation). In the case of the latter control, for example, a timing and a direction of a start of displacement of registration roller pair 53*a* for sheet S are registered as preset values (fixed values) in, e.g., a memory, and control section 100 reads such preset values at the time of execution of a print job and starts displacement of registration roller pair 53*a*.

Furthermore, where an amount of deviation of a side end of sheet S during conveyance is known in advance, such amount of deviation may be registered as a preset value (fixed value) in, e.g., a memory, together with an amount of displacement of registration roller pair 53*a*. In this case, control section 100 outputs a control signal to the drive source for registration roller pair 53*a* to cause registration roller pair 53*a* to perform a favorable displacement (vibration) operation corresponding to such amount of displacement.

The values of the displacement timing and the displacement amount of registration roller pair 53*a* (that is, the preset values) can be different depending on the above-described image forming conditions (that is, the type of sheet S, the temperature and the humidity, etc.). Therefore, the preset values may also be registered in respective operation tables provided for the above-described image forming conditions.

Also, where it is necessary to repeat displacement of registration roller pair 53*a*, for example, where sheet S is an elongated sheet, e.g., a plurality of (N) displacement start timings may be set as preset values.

In general, as described above, a manner and an amount of sub-scanning skew vary depending on individual differences in alignment and/or a difference between the near side and the far side of each of rollers in the respective apparatuses, and after installment of image forming apparatus 1 in, e.g., a room, such manner and amount do not vary largely, and become constant in the relevant machine. As a result of the present inventors conducting various tests based on such knowledge, the present inventors found that in order to correct a sub-scanning skew, basically, it is not necessary to depend on a result of detection by line sensor 54, for a start of operation of registration displacement, and control may be performed based on a preset value that sets a displacement timing. In the later-described flowchart, an example of control will be described where preset values that set a timing for displacement, a direction of displacement and an amount of displacement are also registered in the above-described operation tables.

Next, other effects obtained from the registration displacement control in the present embodiment will be described with reference to FIGS. 16 and 17.

As described above, in the registration displacement control in the present embodiment, registration roller pair 53*a* is consistently displaced to the opposite sides in the width direction (LR) to bring sheet S close to target position TP, and thus, during registration displacement, registration roller pair 53*a* operates so as to vibrate in the width direction. Employment of, for example, a configuration in which a member like a scraper is brought into abutment with registration roller pair 53*a* using such behavior enables increase in effect of removing paper dust of sheet S, dirt or the like sticking to registration roller pair 53*a*.

Figure 16A:
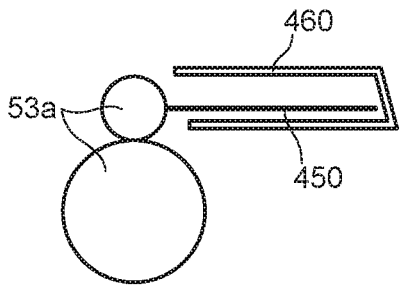
FIGS. 16A and 16B are diagrams illustrating another effect relating to registration displacement control in Embodiment 3.
Figure 16B:
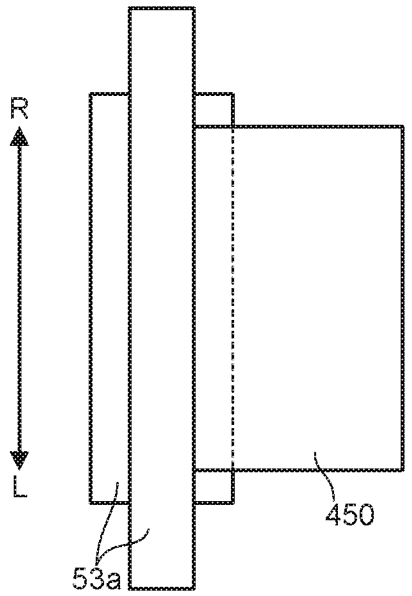

FIGS. 16A and 16B indicate an example configuration in which plate-like scraper 450 for cleaning a surface of an upper roller to be brought into contact with an image forming surface of sheet S from among registration roller pair 53*a* is disposed on the roller.

Here, scraper 450 has a flat and substantially rectangular shape and has a width that is longer than a width of sheet S to be conveyed, and the distal end side (edge part) of scraper 450 is in contact with a roller surface of the upper registration roller, and the other end side of scraper 450 is fixed to the apparatus body. Also, as illustrated in FIG. 16A, collection container 460 for collecting power dust, etc., is provided on the other end side of scraper 450.

In the present embodiment, the entirety of registration roller pair 53*a* is displaced in such a manner that registration roller pair 53*a* vibrates in small motions in the width direction indicated by the double arrow in FIG. 16B (that is, the L and R directions), providing the advantage of an increase in the effect of, if, e.g., paper dust of sheet S sticks to the roller surface of the upper registration roller, the paper dust being scrapped off by scraper 450.

Figure 17A:
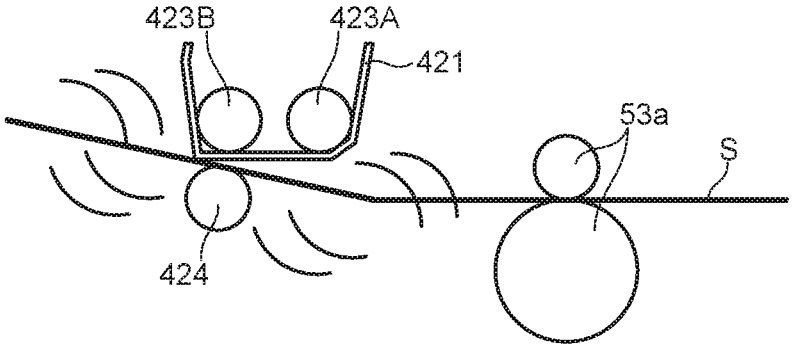
FIGS. 17A and 17B are diagrams illustrating another effect relating to registration displacement control in Embodiment 3.

Further effects of the registration displacement control in Embodiment 3 will be described with reference to FIGS. 17A and 17B.

In the present embodiment, vibration in the width direction of registration roller pair 53*a* during displacement may be, for example, high-speed vibration in small motions of around 1 to 10 kHz in AC frequency components or higher (for example, an ultrasound vibration band of 20 kHz or higher). Where registration roller pair 53*a*, thus, sheet S is vibrated in small motions as above, as schematically illustrated in FIG. 17A, vibration of sheet S during registration displacement propagates also to a secondary transfer section, and enhancement in toner image transfer capability can be expected.

Figure 17B:
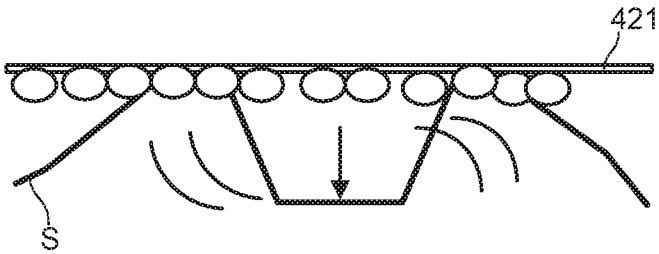

FIG. 17B indicates an example case where an embossed sheet including recesses and projections in a surface thereof is fed to the secondary transfer section as sheet S. As illustrated in FIG. 17B, in general, in an embossed sheet or the like, there is a distance between a toner image formed on a surface of the secondary transfer section and each recess of sheet S, and thus, the toner image is not easily transferred to the recess of sheet S.

On the other hand, according to the present embodiment, during registration displacement, vibration of registration roller pair 53*a* is indirectly transmitted to the secondary transfer nip through sheet S, and thus, toner (toner grains) formed on the secondary transfer section easily drop down (see the arrow in FIG. 17B).

Therefore, according to the present embodiment, a toner image (toner grain positions) formed on the secondary transfer section can be transferred even onto sheet S that is less easily subjected to transfer such as an embossed sheet without disturbing the toner image, enabling enhancement in transfer capability.

Figure 18:
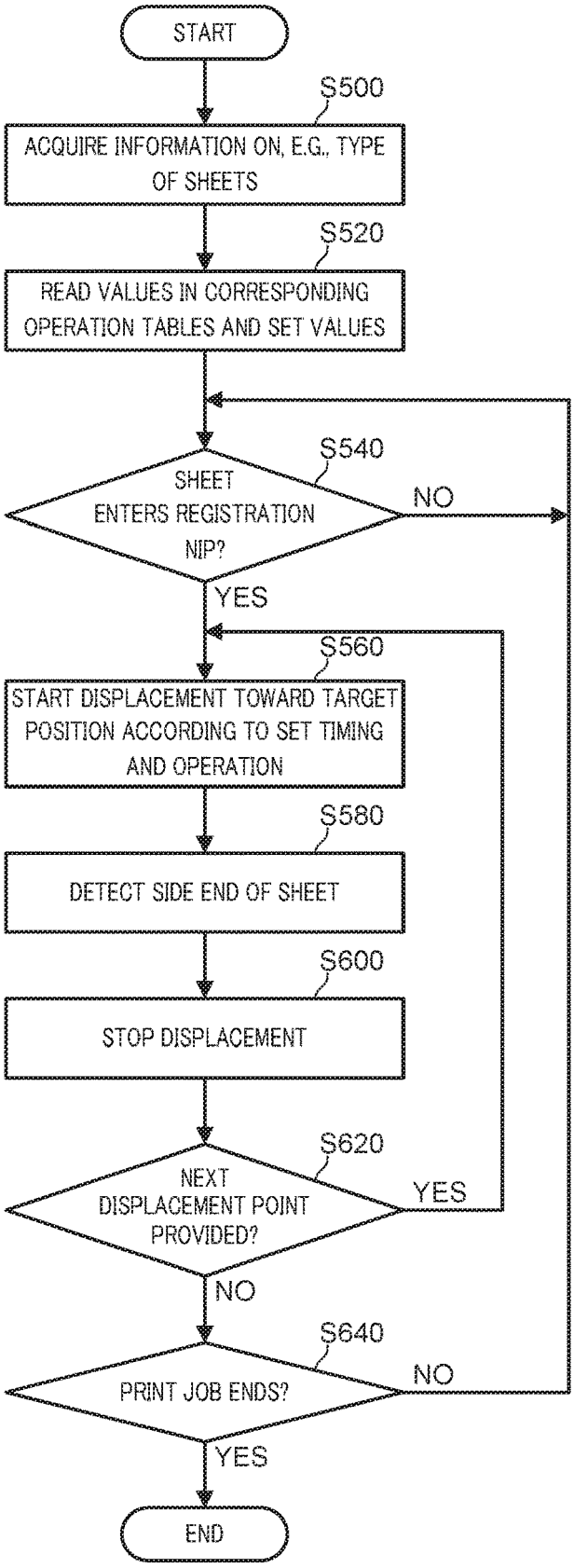
FIG. 18 is a flowchart illustrating an example of conveyance control for registration displacement in an image forming apparatus according to Embodiment 3.

An example of an operation for control of displacement of registration roller pair 53*a*, thus, sheet S in image forming apparatus 1 will be described with reference to the flowchart in FIG. 18. The illustrated flowchart indicates an example of control in the case where elongated sheet S having a long length in conveyance direction (for example, a size exceeding 487.7 mm) is conveyed. Such elongated sheet can be stored in none of sheet feed trays in image forming apparatus 1, and thus, a sheet feeding apparatus dedicated for elongated sheets is connected to image forming apparatus 1 to convey such elongated sheet, and in addition, such elongated sheet is more likely to cause a sub-scanning skew and has a high need for performing registration displacement a plurality of times. The illustrated flowchart indicates an example of control for conveying (performing printing on) a plurality of elongated sheets in such example case.

At the time of execution of a print job, control section 100 acquires information on, e.g., a type (e.g., size, basis weight (toughness), glossiness, recycled paper or not) of sheets S to be subjected to printing from user setting formation for a print job (step S500).

In step S520, control section 100 reads respective values registered in operation tables for the acquired image forming condition (type of the sheet in this example) and sets a start timing (hereinafter referred to as "displacement point") of each of a plurality N of displacements of sheet S, a direction of the displacement, and a content of operation (vibration) in the displacement in advance.

Subsequently, control section 100 waits until sheet S enters a registration nip formed by registration roller pair 53*a* (NO in step S540), and upon sheet S entering the registration nip (YES in step S540), proceeds to step S560.

In step S560, control section 100 performs control to start displacement of registration roller pair 53*a* toward target position TP (first direction), according to the values set in step S520, that is, the displacement timing and the content of operation (vibration) registered in the operation tables (see FIG. 15A).

With such control, for sheet S that has entered the registration nip, registration roller pair 53*a* is displaced in a direction in which positional deviation of sheet S is corrected while vibrating to the left and the right, at a timing according to the relevant operation table (preset value), and along with the displacement, sheet S is displaced while vibrating in the width direction.

Subsequently, control section 100 turns line sensor 54 on at a timing before a side end of sheet S reaches target position TP to detect a position of the side end of sheet S (step S580), and performs control registration roller pair 53*a* to stop displacement based on a result of the detection by line sensor 54 (step S600). In the stoppage control in step S600, as described above, control section 100 may determine whether or not an overrun of the side end of sheet S occurs and perform control for reduction according to a result of the determination (e.g., switching to a signal for vibration reduction) as necessary.

Subsequently, control section 100 determines whether or not there is a next displacement point (step S620), and if control section 100 determines that there is a next displacement point (YES in step S620), returns to step S560 and repeats the above-described processing in steps S560 to S620.

Therefore, as described above, if a plurality of displacement points are set for sheet S, control to start and stop displacement of registration roller pair 53*a* is repeated.

On the other hand, if control section 100 determines that there is no next displacement point (NO in step S620), control section 100 proceeds to step S640.

In step S640, control section 100 determines whether or not the print job ends. As a result of the determination, if the print job does not end (NO in step S640), control section 100 returns to step S540, and upon next sheet S entering the registration nip (YES in step S540), performs printing processing such as control of displacement of registration roller pair 53*a* and formation of an image for relevant sheet S. On the other hand, if control section 100 determines that the print job ends (YES in step S640), control section 100 ends the above-described series of processing.

As described in detail above, according to Embodiment 3, in an operation of displacing registration roller pair 53*a* in a positive direction, control to repeat movement in the positive direction and movement in a negative direction that is opposite to the positive direction to bring a side end of sheet S close to target position TP is performed, enabling prevention or suppression of excessive displacement (overrun).

Therefore, according to the present embodiment, a sub-scanning skew of sheet S due to, e.g., misalignment and/or a difference in diameter in the width direction of each of rollers can more accurately corrected in comparison to conventional control, that is, can be corrected so that generation of a defective image is effectively prevented.

The above example configuration has been described in terms of a case where registration roller pair 53*a* is displaced according to a timing provided by a preset value. However, the present embodiment may perform control to displace registration roller pair 53*a* when positional deviation of a side end of sheet S is detected by line sensor 54.

The above example configuration has been described in terms of a case where registration roller pair 53*a* is displaced both before and during transfer of an image by the secondary transfer nip. However, in the present embodiment, displacement of registration roller pair 53*a* may be performed only before transfer of an image by the secondary transfer nip or may be performed only during transfer of an image by the secondary transfer nip. Generally, in the present embodiment, displacement of registration roller pair 53*a* can be performed during an arbitrary period of time after a front end of sheet S entering the registration nip, according to a timing provided by a preset value.

The above example configuration has been described in terms of a case where the content of displacement (vibration) of registration roller pair 53*a* (that is, an operation table to be used) is changed according to, e.g., the type of sheet S or the hygrothermal environment. As another example, settings can be made to be selected via, e.g., a non-illustrated user setting screen so as not to perform the above-described displacement operation (movement in both positive and negative directions) of registration roller pair 53*a*, depending on, e.g., the type of sheet S or the hygrothermal environment. For example, a condition in which excessive displacement of registration roller pair 53*a* or a side end of sheet S is less likely to occur is registered in advance, and under such condition, control section 100 performs registration displacement control to displace registration roller pair 53*a* only in the positive direction, rather than in both the positive and negative directions.

Alternatively, as another example, settings can be made to be selected via, e.g., a non-illustrated user setting screen so as not to perform the above-described displacement operation (movement in both positive and negative directions) of registration roller pair 53*a*, depending on the amount of operation of registration roller pair 53*a* (e.g., amount of deviation of the side end of sheet S from target position TP). For example, a value of an operation amount (e.g., an amount of deviation of a side end of sheet S) in which excessive displacement of registration roller pair 53*a* or a side end of sheet S is less likely to occur is registered in advance, and in the case of such value, control section 100 performs registration displacement control to move registration roller pair 53*a* only in the positive direction, rather than in both positive and negative directions.

Although the above example configuration has been described on the premise that sheet S is an elongated sheet, registration displacement control according to the present embodiment can be applied regardless of the length in the conveyance direction of sheet S, and thus, can be applied to standardized sheets such as A4-size sheets. More specifically, from among the standardized sheets, in the case of sheets that can be easily bent upon conveyance, for example, thin sheets, excessive displacement (overrun of a side end of a sheet) relatively more likely to occur, and thus, the registration displacement control according to the present embodiment can be employed.

However, in general, since as sheet S is longer in the conveyance direction, a degree (amount) of deviation of a side end of sheet S from target position TP tends to be larger, the registration displacement control according to the present embodiment is particularly effective for a case where a sub-scanning skew of an elongated sheet is to be corrected.

The above example configuration has been described in terms of a case where settings are made so that a side end of sheet S slightly runs over target position TP (overruns) by a displacement operation of registration roller pair 53*a*. However, in the registration displacement control according to the present embodiment, for example, control to make an amount of motion (amplitude in the left and right directions) of registration roller pair 53*a* smaller as a side end of sheet S comes closer to target position TP is performed, enabling registration roller pair 53*a* to be stopped so as to prevent the side end of sheet S from running over target position TP.

In the above example configuration, in displacement operation in both the positive and negative directions, the control to stop registration roller pair 53*a* (that is, to complete the displacement operation) at a position at which a side end of sheet S reaches target position TP has been described. However, in registration displacement control, forming a toner image transferred by the secondary transfer nip at a desired position on sheet S, in other words, moving registration roller pair 53*a* so as to prevent a side end of sheet S in the secondary transfer nip from deviating from target position TP, is important. Therefore, in the registration displacement control in the present embodiment, in order to prevent a side end of sheet S in the secondary transfer nip from deviating from target position TP, control section 100 may fine-adjust a final stopping position of registration roller pair 53*a* by, e.g., applying a correction value to a value set as a preset value.

[Supplement]

According to Embodiment 3 described above, the technical ideas and configurations stated in [1] to [11] below can be derived.

[1] In an operation of displacing a sheet conveyance member in a positive direction in which an end part in a width direction of sheet S moves toward target position TP, control section 100 performs control to repeat movement in the positive direction of the sheet conveyance member (53*a*) and movement in a negative direction of the sheet conveyance member (53*a*), the negative direction being opposite to the positive direction, to bring the end part of the sheet S close to target position TP.

[2] In the configuration in [1] above, control section 100 controls the displacement of the sheet conveyance member (53*a*), using operation setting values that set an operation in the positive direction of the sheet conveyance member (53*a*) and an operation in the negative direction of the sheet conveyance member (53*a*).

[3] In the configuration in [2] above, the operation setting values include values relating to respective distances of movement in the positive direction and the negative direction of the sheet conveyance member (53*a*).

[4] In the configuration in [2] or [3] above, the operation setting values include values relating to respective time lengths of movement in the positive direction and the negative direction of the sheet conveyance member (53*a*).

[5] In the configuration in any of [2] to [4] above, the operation setting values are set according to an image forming condition.

[6] In the configuration in [5], a table with the operation setting values registered therein for the image forming condition is provided.

[7] In the configuration in [5] or [6] above, the image forming condition is a sheet type.

[8] In the configuration in [5] or [6] above, the image forming condition is a temperature and a humidity around the image forming apparatus.

[9] In the configuration in any of [1] to [8] above, after a start of a movement operation in the positive direction or the negative direction of the sheet conveyance member (53*a*), control section 100 performs control to stop the movement operation upon the end part of the sheet reaching a predetermined position, based on a position of the end part in the width direction of sheet S, the position being detected by a detection section (54) that detects an end part in the width direction of sheet S, during the movement operation.

[10] In the configuration in any of [1] to [9] above, control section 100 controls the displacement of the sheet conveyance member (53*a*) so that a period of the movement in the positive direction is longer than a period of the movement in the negative direction.

[11] In the configuration in any of [1] to [10] above, control section 100 controls the displacement of the sheet conveyance member (53*a*) so as to, after moving the sheet conveyance member (53*a*) in the positive direction, move the sheet conveyance member in the negative direction for a distance that is smaller than a distance of the movement in the positive direction.

Each of the above embodiments has been described in terms of an example of an image forming apparatus including a transfer section that secondary-transfers an image to be printed, onto sheet S using an intermediate transfer belt. However, the above embodiments are applicable also to image forming apparatuses of a transfer type in which an image to be printed is primary-transferred onto sheet S (for example, a monochrome printer, an inkjet printer, etc.).

Each of the above embodiments has been described in terms of a case where a sheet conveyance member provided upstream of a secondary transfer nip, the sheet conveyance member being subjected to displacement control by a control section, is a registration roller pair. As another example, for a sheet conveyance member, for example, a roller other than a registration roller pair, a sheet conveyance guide, etc., can be employed additionally or as an alternative.

Each of the above embodiments has been described in terms of a case where flat sheets are used as sheets. However, the above embodiments are applicable also to rolled sheets.

In addition, the configurations described in the respective embodiment can arbitrarily be combined.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus in which a sheet is conveyed to a position where an image is transferred by a transferrer to transfer the image onto the sheet, the apparatus comprising:

displacement rollers including at least a pair of rollers for conveying an incoming sheet toward the transferrer;

a detector that detects a position of a side end part of the sheet;

a memory that stores displacement control information; and a hardware processor that performs processing for displacing the displacement rollers based on the displacement control information stored in the memory and correcting the displacement control information for next and subsequent sheets based on a detection result of the detection by the detector after the displacement of the displacement rollers by updating the displacement control information stored in the memory.

2. The image forming apparatus according to claim 1, wherein the hardware processor displaces the displacement rollers based on the detection result of the detection by the detector and the displacement control information.

3. The image forming apparatus according to claim 1, wherein:

the hardware processor displaces the displacement rollers at a plurality of positions in a sheet conveyance direction, for one said sheet;

the hardware processor corrects the displacement control information for at least one of the plurality of positions on next and subsequent sheets based on respective detection results of the detection by the detector after the displacement of the displacement roller at the plurality of positions; and the displacement control information is not necessarily constant for each of the plurality of positions.

4. The image forming apparatus according to claim 1, wherein the hardware processor calculates an inclination of the sheet based on detection results of the detection by the detector at a plurality of positions in a sheet conveyance direction after the displacement of the displacement roller and corrects the displacement control information for next and subsequent sheets based on the calculated inclination of the sheet.

5. The image forming apparatus according to claim 4, wherein the hardware processor calculates the inclination of the sheet based on detection results of the detection by the detector at the plurality of positions after the displacement of the displacement roller and before next displacement and corrects the displacement control information for next and subsequent sheets based on the calculated inclination of the sheet.

6. The image forming apparatus according to claim 1, wherein the hardware processor corrects the displacement control information for next and subsequent sheets based on detection results of the detection of a plurality of the sheets by the detector.

7. The image forming apparatus according to claim 1, wherein for each of conditions relating to sheet conveyance, the hardware processor corrects the displacement control information for a next sheet having a condition that is the same as the condition.

8. The image forming apparatus according to claim 1, wherein where an image is transferred to each of opposite sides of the sheet, the hardware processor corrects the displacement control information for a back side of the sheet based on information on a front side of the sheet.

9. The image forming apparatus according to claim 1, wherein the hardware processor stores the displacement control information corrected based on the detection result of the detection by the detector after the displacement of the displacement rollers, in a storage section.

10. The image forming apparatus according to claim 1, wherein an adjustment mode in which the sheet is fed and subjected to detection of a position of a side end part of the sheet by the detector, and the displacement control information is set or corrected based on a result of the detection.

11. The image forming apparatus according to claim 1, wherein the hardware processor displaces the displacement rollers after the sheet entering the transferrer and corrects the displacement control information for next and subsequent sheets based on the detection result of the detection by the detector after the displacement of the displacement rollers.

12. The image forming apparatus according to claim 1, wherein the hardware processor displaces the displacement rollers in a direction orthogonal to a sheet conveyance direction of the sheet.

13. An image forming apparatus in which a sheet is conveyed to a position where an image is transferred by a transferrer to transfer the image onto the sheet, the apparatus comprising:

displacement rollers including at least a pair of rollers for conveying an incoming sheet toward the transferrer;

a detector that detects a position of a side end part of the sheet; and a hardware processor that performs processing for displacing the displacement rollers based on displacement control information and correcting the displacement control information for next and subsequent sheets based on a detection result of the detection by the detector after the displacement of the displacement rollers, wherein the hardware processor decreases a displacement speed of the displacement rollers at a position short of a position at which the side end part of the sheet reaches a target position; and the hardware processor stops the displacement of the displacement rollers upon the side end part of the sheet reaching the target position.

14. The image forming apparatus according to claim 13, wherein the hardware processor displaces the displacement rollers in a direction in which the side end part of the sheet approaches the target position.

15. The image forming apparatus according to claim 13, wherein in an operation of displacing the displacement rollers in a positive direction in which the side end part of the sheet moves toward the target position, the hardware processor performs control to repeat movement in the positive direction of the displacement rollers and movement in a negative direction of the displacement rollers, the negative direction being opposite to the positive direction, to bring the side end part of the sheet close to the target position.

16. An image forming apparatus in which a sheet is conveyed to a position where an image is transferred by a transferrer to transfer the image onto the sheet, the apparatus comprising:

a rotor capable of rotating the sheet that is being conveyed;

a detector that detects a position of a side end part of the sheet;

a memory that stores rotation control information; and a hardware processor that rotates the sheet based on the rotation control information stored in the memory and corrects the rotation control information for next and subsequent sheets based on a detection result of the detection by the detector after the rotation of the sheet by updating the rotation control information stored in the memory.

17. A displacement roller control method for an image forming apparatus including displacement rollers including at least a pair of rollers conveying a sheet that is being conveyed, toward a transferrer, a memory that stores displacement control information, and a detector that detects a position of a side end part of the sheet, the method comprising:

displacing the displacement rollers based on displacement control information stored in the memory of the image forming apparatus; and correcting the displacement control information for next and subsequent sheets based on a detection result of detection by the detector after the displacement of the displacement rollers by updating the displacement control information stored in the memory of the image forming apparatus.

18. A displacement roller control method for an image forming apparatus including displacement rollers including at least a pair of rollers conveying a sheet that is being conveyed, toward a transferrer, and a detector that detects a position of a side end part of the sheet, the method comprising:

displacing the displacement rollers based on displacement control information;

correcting the displacement control information for next and subsequent sheets based on a detection result of detection by the detector after the displacement of the displacement rollers;

decreasing a displacement speed of the displacement rollers at a position short of a position at which the side end part of the sheet reaches a target position; and stopping the displacement of the displacement rollers upon the side end part of the sheet reaching the target position.

19. The control method according to claim 18, comprising displacing the displacement rollers in a direction in which the side end part of the sheet approaches the target position.

20. The control method according to claim 18, comprising, in an operation of displacing the displacement rollers in a positive direction in which the side end part of the sheet moves toward the target position, performing control to repeat movement in the positive direction of the displacement rollers and movement in a negative direction of the displacement rollers, the negative direction being opposite to the positive direction, to bring the side end part of the sheet close to the target position.

* * * * *